US011214996B2

(12) United States Patent
Baker et al.

(10) Patent No.: US 11,214,996 B2
(45) Date of Patent: Jan. 4, 2022

(54) RETROFIT LATCH ADAPTER

(71) Applicant: ASSA ABLOY Accessories and Door Controls Group, Inc., New Haven, CT (US)

(72) Inventors: Vincent Baker, Rockwood, PA (US); Douglas Thompson, Somerset, PA (US); Michael Connell, Connellsville, PA (US); Catelyn Herman, Berlin, PA (US)

(73) Assignee: ASSA ABLOY Accessories and Door Controls Group, Inc., New Haven, CT (US)

( * ) Notice: Subject to any disclaimer, the term of this patent is extended or adjusted under 35 U.S.C. 154(b) by 65 days.

(21) Appl. No.: 16/521,353

(22) Filed: Jul. 24, 2019

(65) Prior Publication Data

US 2020/0131816 A1 Apr. 30, 2020

Related U.S. Application Data

(60) Provisional application No. 62/751,297, filed on Oct. 26, 2018.

(51) Int. Cl.

| | |
|---|---|
| ***E05C 19/00*** | (2006.01) |
| ***E05C 9/00*** | (2006.01) |
| *E05C 3/12* | (2006.01) |

(52) U.S. Cl.

CPC ..... *E05C 19/007* (2013.01); *E05C 9/008* (2013.01); *E05C 2003/126* (2013.01); *E05Y 2600/60* (2013.01)

(58) Field of Classification Search

CPC .. E05C 19/007; E05C 9/008; E05C 2003/126; E05C 1/14; E05Y 2600/60;

(Continued)

(56) References Cited

U.S. PATENT DOCUMENTS

| | | | |
|---|---|---|---|
| 1,516,995 | A | 11/1924 | Trigueiro |
| 2,561,606 | A | 7/1951 | Bates |

(Continued)

OTHER PUBLICATIONS

International Preliminary Report on Patentability for International Application No. PCT/US2018/028118, dated Oct. 31, 2019.

(Continued)

*Primary Examiner* — Jason L Vaughan
*Assistant Examiner* — Amanda Kreiling
(74) *Attorney, Agent, or Firm* — Wolf, Greenfield & Sacks, P.C.

(57) ABSTRACT

A retrofit latch adapter is configured to replace a pre-existing roller head latch assembly of a pre-existing exit device. The retrofit latch adapter may include a flat latch head that may provide additional security for a door compared with the pre-existing roller head pre-existing latch assembly. A method of installing such a retrofit latch adapter in a preexisting exist device may include rotationally releasing a pre-existing latch assembly having a roller latch head from the pre-existing exit device; rotating the pre-existing latch assembly to linearly decouple the pre-existing latch assembly from a transmission of the pre-existing exit device; removing the pre-existing latch assembly from the pre-existing exit device; rotating the retrofit latch adapter to linearly couple the retrofit latch adapter to the transmission of the pre-existing exit device; inserting the retrofit latch adapter at least partially into a housing of the pre-existing exit device; aligning the flat latch head with an uppermost portion of the housing of the pre-existing exit device; and rotationally securing the retrofit latch adapter to the pre-existing exit device.

18 Claims, 20 Drawing Sheets

(58) Field of Classification Search
CPC ..... E05B 15/10; E05B 2015/107; E05B 47/0046; E05B 15/0205; E05B 1/0015; E05B 65/0025
See application file for complete search history.

(56) References Cited

U.S. PATENT DOCUMENTS

| | | | |
|---|---|---|---|
| 2,581,606 | A | 1/1952 | Seaman et al. |
| 2,813,737 | A | 11/1957 | Reiter |
| 3,359,027 | A | 12/1967 | Schlage et al. |
| 3,792,887 | A | 2/1974 | Ramsey |
| 4,372,594 | A | 2/1983 | Gater |
| 4,711,477 | A | 12/1987 | Fann et al. |
| 4,711,480 | A | 12/1987 | Horgan, Jr. |
| 5,074,605 | A | 12/1991 | Fann et al. |
| 5,152,558 | A | 10/1992 | Smith et al. |
| 5,364,138 | A | 11/1994 | Dietrich et al. |
| 5,562,314 | A | 10/1996 | Wheatland et al. |
| 7,753,410 | B2 * | 7/2010 | Coultrup ..... B60R 22/32 280/808 |
| 9,169,669 | B2 | 10/2015 | Clary et al. |
| 2002/0093204 | A1 | 7/2002 | Hartman |
| 2008/0315596 | A1 | 12/2008 | Terry et al. |
| 2014/0239651 | A1 | 8/2014 | Shilts |
| 2016/0215525 | A1 | 7/2016 | Ramakrishna |
| 2017/0022736 | A1 | 1/2017 | Nguyen |
| 2017/0275926 | A1 | 9/2017 | Kumar et al. |
| 2018/0305953 | A1 | 10/2018 | Thompson et al. |

OTHER PUBLICATIONS

International Search Report and Written Opinion for International Application No. PCT/US2018/028118, dated Jun. 29, 2018.
[No Author Listed] Door Manual for CRL Panic Handle PA100A Series For All Glass Door. Blumcraft, a Division of C. R. Laurence Co., Inc. 2003, 24 pages.
PCT/US2018/028118, Oct. 31, 2019, International Preliminary Report on Patentability.
U.S. Appl. No. 15/956,147, filed Apr. 18, 2018, Thompson et al.
PCT/US2018/028118, Jun. 29, 2018, International Search Report and Written Opinion.

* cited by examiner

RETROFIT LATCH ADAPTER

RELATED APPLICATIONS

This Application claims the benefit under 35 U.S.C. § 119(e) of U.S. Provisional Application No. 62/751,297, filed Oct. 26, 2018, entitled "RETROFIT LATCH ADAPTER", the contents of which are incorporated herein by reference in their entirety.

FIELD

Disclosed embodiments are related to retrofit latch adapters for exit devices and related methods of use.

BACKGROUND

In some cases, vertical rod door latches are employed in commercial or public buildings where the door latches are located at the top and/or bottom edge of the door. The latches are typically operable by a transmission including vertical rods extending from an actuator to the top and/or bottom latches. The actuator most commonly used to drive the latch points of a vertical rod door latch includes a lever handle, a push bar, or push rail type exit device.

SUMMARY

According to one embodiment, a method of installing a retrofit latch adapter having a flat latch head in a pre-existing exit device includes rotationally releasing a pre-existing latch assembly having a roller latch head from the pre-existing exit device, rotating the pre-existing latch assembly to linearly decouple the pre-existing latch assembly from a transmission of the pre-existing exit device, and removing the pre-existing latch assembly from the pre-existing exit device. The method also includes rotating the retrofit latch adapter to linearly couple the retrofit latch adapter to the transmission of the pre-existing exit device, inserting the retrofit latch adapter at least partially into a pre-existing exit device housing, aligning the flat latch head with an uppermost portion of the pre-existing exit device housing, and rotationally securing the retrofit latch adapter to the pre-existing exit device.

According to another embodiment, a retrofit latch adapter for a pre-existing exit device includes a latch body configured to be received in a pre-existing exit device housing, and a latch slide including a flat portion and a strike portion, where the latch slide is slidably secured to the latch body, and where the latch slide is moveable between an engaged position and a disengaged position. The retrofit latch adapter also includes a latch rod including a head portion configured to receive a pin and a male thread and a biasing member configured to bias the latch slide toward the engaged position, where the latch rod is configured to move the latch slide to the disengaged position when tension is applied to the shaft portion.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
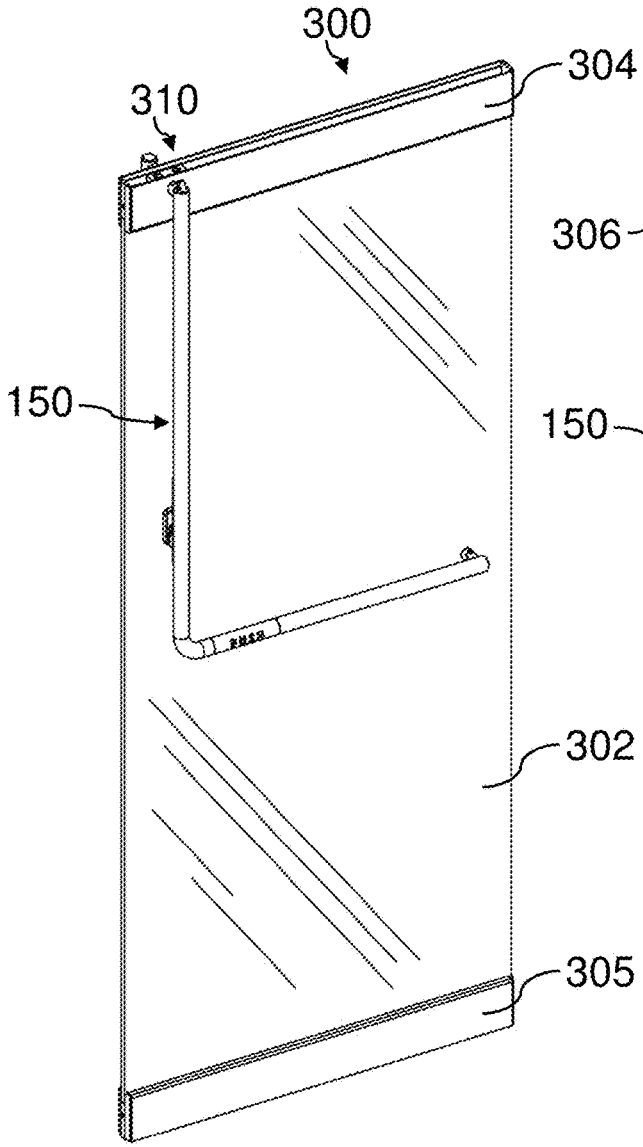
FIG. 1 depicts one embodiment of a glass door including an exit device.

Conventionally, glass doors employ vertical rod latches which extend from the bottom and/or top of the glass door. The vertical rod latches and associated transmission may be more easily concealable in an exit device housing to improve the aesthetics of a glass door. Typically, these vertical rod latches include a roller latch head which extends into a door strike adjacent the top and/or bottom of the glass door. However, the roller latch presents installation and security challenges. One such challenge is when a roller latch does not protrude far enough into the strike, it may be possible to open the door with sufficient force, even if the latch is not retracted. Moreover, roller latches may be more susceptible to latch bypass techniques such as biding. Additionally, the flexibility of the glass under force may result in latching failure for roller latches.

In view of the above, the inventors have recognized the benefits of a retrofit latch adapter which may be used to replace a roller latch with a flat latch. In particular, the retrofit latch adapter is configured to replace a roller latch assembly of a pre-existing exit device, so that the pre-existing transmission of the exit device may be retained. Such an arrangement may improve the security of glass doors while reducing cost and simplifying a flat latch installation.

As used herein, an "exit device" is a lock mechanism operated from the inside of an exit door through the use of a crossbar, push bar, push rail, panic bar or paddle actuator that moves toward the exit door to retract the latch head when pressure is applied.

In some embodiments, a retrofit latch adapter for an exit device includes a latch body, a latch slide, and a latch rod. The latch body may be configured to fit closely in an exit device housing, such that the retrofit latch adapter may be removably secured to the exit device. The latch slide may include a latch head having a flat portion and a strike portion. The latch slide may also be slidably disposed in the latch body so that the latch slide is slidable between an engaged position where the flat portion and strike portion engage a strike and a disengaged position where the flat portion and strike portion clear the strike. Accordingly, the engaged position may correspond with a latched position which secures an associated door and the disengaged position may correspond with an unlatched position where the associated door is unsecured. In some embodiments, the latch slide may be slid between the engaged and disengaged positions by force applied via a latch rod. The latch rod may be coupled to an exit device transmission so that the latch slide is moved to the disengaged position when tension is applied to the latch rod by the transmission. The retrofit latch adapter may also include a biasing member configured to bias the latch slide toward to the engaged position, such that when there is no tension applied to the latch rod the latch slide moves to the engaged position.

In some embodiments, a method of installing a retrofit latch adapter in an exit device includes rotationally releasing a pre-existing latch assembly from the exit device. The pre-existing latch assembly may include a roller latch or any other latch which may be desirable to replace. Rotationally releasing the pre-existing latch assembly may include slidably releasing a transmission of the exit device from a housing of the exit device so that the transmission and pre-existing latch assembly may be at least partially slid or otherwise moved out of the exit device housing. The method of installation may include rotating the pre-existing latch assembly to linearly decouple the pre-existing latch assembly from a transmission and removing the pre-existing latch assembly from the exit device. Once the pre-existing latch assembly has been removed, the method may further include rotating the retrofit latch adapter to linearly couple the retrofit latch adapter to the transmission of the exit device. After the retrofit latch adapter has been linearly coupled to the transmission, the retrofit latch adapter may be inserted into the exit device housing where the retrofit latch adapter may be rotationally secured to the housing. In some embodiments, prior to being rotationally secured, the retrofit latch adapter may be rotated to adjust a distance between the distal most portion of the exit device housing and the distal most portion of the retrofit latch adapter (i.e., a distance which the retrofit latch adapter extends from the exit device housing).

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 2:
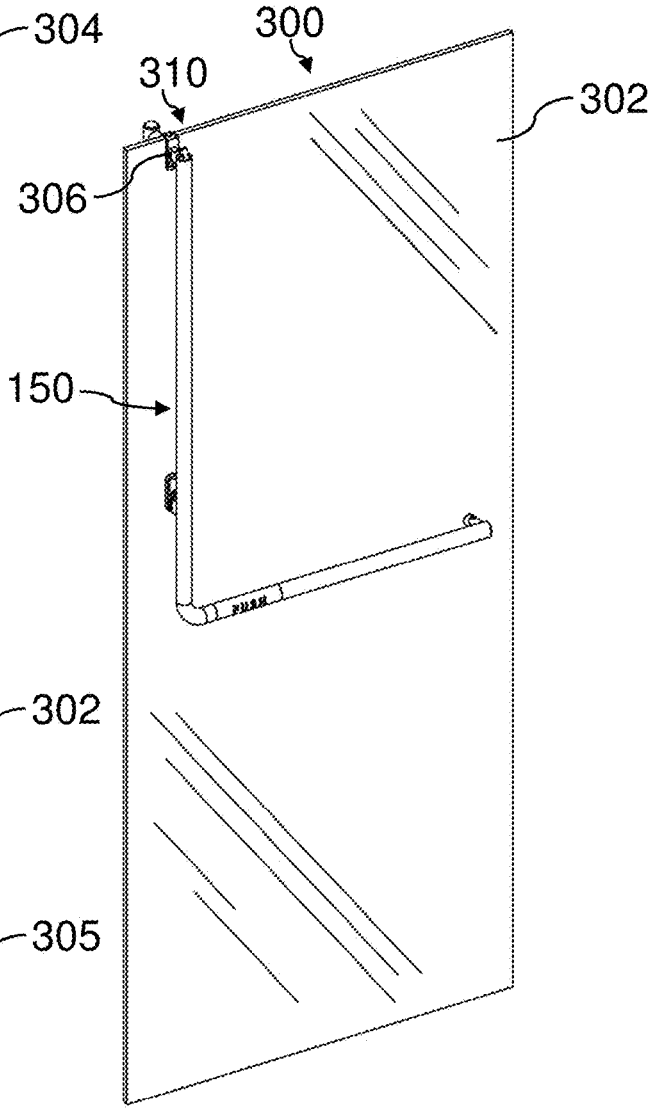
FIG. 2 depicts another embodiment of a glass door including an exit device.

FIGS. 1-2 depict two embodiments of a glass door 300 including an exit device 150 and latch 310. As shown in FIG. 1, the exit device is mounted to a glass pane 302 of the glass door as well as an upper rail 304 which runs the width of the glass pane. The exit device includes a latch 310 configured to secure the door when engaged with a door strike. The latch 310 may be configured as a part of a pre-existing latch assembly or as a retrofit latch adapter. Without wishing to be bound by theory, the upper rail may distribute forces from the exit device across the entire width of the glass pane. According to the embodiment of FIG. 1, the exit device is configured to be pushed in towards the door to move the latch to a retracted position and release the door. The embodiment shown in FIG. 2 includes a glass mount 306 which couples the exit device 150 directly to the glass pane 302. Accordingly, force from the exit device is transmitted from the exit device to the glass pane through the glass mount, and is not spread over the width of the glass pane like the embodiment of FIG. 1. Of course, any suitable mounting solution for the exit device may be employed, as the present disclosure is not so limited.

Figure 3:
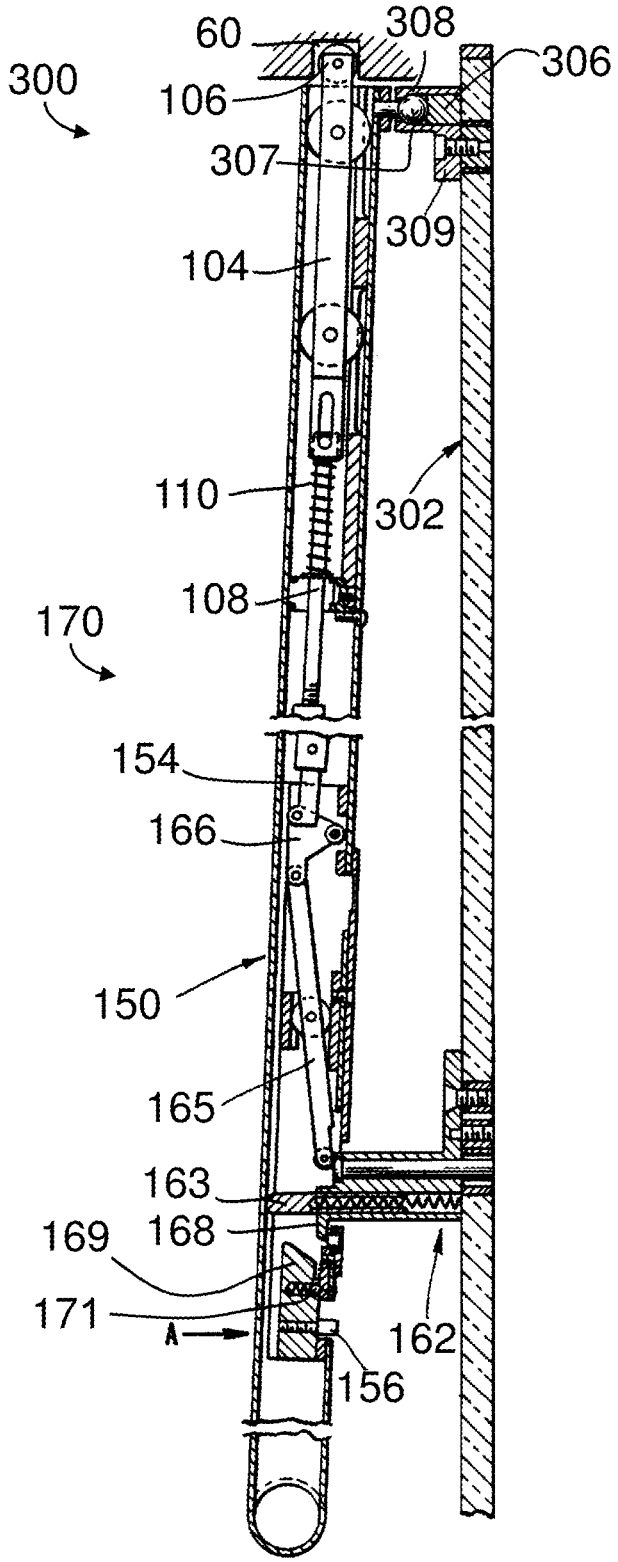
FIG. 3 depicts an internal view of one embodiment of an exit device transmission.

FIG. 3 depicts an internal view of one embodiment of a conventional transmission 170 of an exit device 150 of a glass door 300. For example, the depicted transmission is conventionally deployed in an exit device for a glass door as described in U.S. Pat. No. 4,711,480, issued Dec. 8, 1987, the disclosure of which is hereby incorporated by reference. As seen in FIG. 3, the exit device 150 is composed of substantially hollow bars or tubes, in which the transmission 170 is disposed for latching and unlatching glass door 300 in response to the pivotal movement of the exit device. In particular, as seen in FIG. 3, a transmission is disposed within the exit device 100 where it is concealed from view so that the exit device has a smooth appearance for desirable aesthetics. The transmission, according to the embodiment of FIG. 3, includes a lever arm 165 and an over-center linkage 166 which apply force to a latch rod 108 and a latch slide 104 of a pre-existing latch assembly or retrofit latch adapter. As shown in FIG. 3, the latch slide 104 includes a roller head 106 consistent with a pre-existing latch assembly which is configured to enter a strike plate (or latch recess) 60 so that the glass door 300 is secured when the latch slide is in an engaged position.

According to the embodiment shown in FIG. 3, the exit device is configured to receive a pushing force to unlatch the glass door 300. Upon application of force to interior exit device 150 in the direction of arrow A, exit device 150 moves towards glass pane 302 and the actuator 162 penetrates the exit device 152 to apply force to the lever arm 165. The lever arm 165 moves to cause the over-center mechanism 166 to move downwardly, which in turn moves latch rod 108 downwardly to withdraw the latch slide 104 from latch recess 60 into the distal end of exit device and unlatch the glass door. Upon removal of the exterior force A, the exit device is restored to its latched position as a result of biasing force applied by the spring-loaded plunger 163 against the exit device as well as the biasing member 110 (e.g., spring) applying a distal biasing force against latch slide 104.

As shown in FIG. 3, the exit device includes a dog button 156 configured to secure the exit device 150 in its innermost position so that the latch slide is moved to a disengaged position and the glass door 300 is kept in an unlatched state. When engaged, the dog button allows the exit device 150 to operate as a stationary door handle. Dog button 156 may be moved upwardly to engage a tab 169 with an inward lip 168 of the actuator 162 to secure the exit device in the unlatched position. Dog button 156 is retained in its upper or lower positions by a spring-loaded locking detent 171.

As also seen in FIG. 3, the exit device 150 is mounted at the upper end of the glass pane 302 by a glass mount 306 similar to the embodiment shown in FIG. 2. In the embodiment of FIG. 3, the glass mount 306 comprises a pane fastener 309 configured to clamp the glass mount on each side of the glass pane. The glass mount includes a socket 307 into which a pivot ball 308 is disposed to support the exit device while allowing the exit devices to pivot to the actuating position described above.

While a conventional transmission according to one conventional embodiment is described herein, it should be understood that any suitable exit device transmission may be employed which actuates a pre-existing latch assembly or retrofit latch adapter, as the present disclosure is not so limited.

Figure 4:
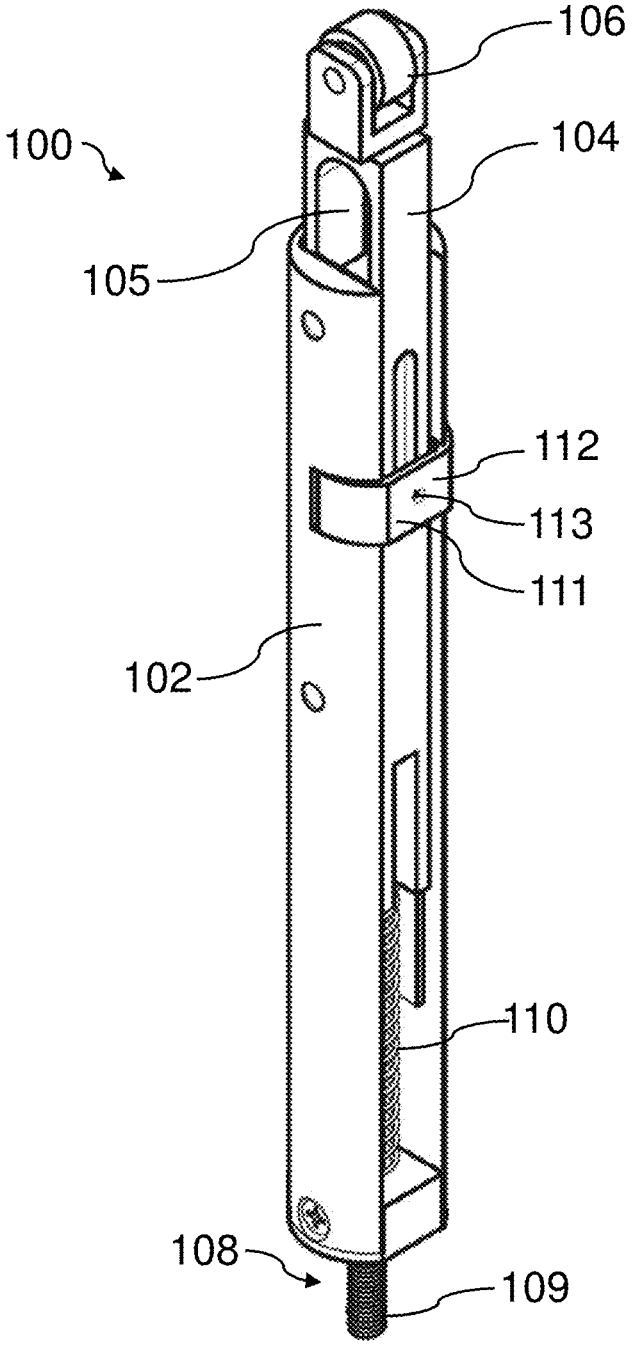
FIG. 4 is perspective view of one embodiment of a pre-existing latch assembly.

FIG. 4 is perspective view of one embodiment of a pre-existing latch assembly 100. As shown in FIG. 4, the pre-existing latch includes a latch body 102, a latch slide 104 having a roller latch head 106, and a latch rod 108. The latch body 102 holds the latch slide and latch rod and is configured to fit closely within an exit device housing. Without wishing to be bound by theory, the close fit between the latch body and the exit device housing results in force transmission between the latch body and exit device housing with little play or lash so that an associated door remains secure when the latch slide is engaged with a strike. The latch slide 104 includes slots 105 through which the latch slide is slidably coupled to the latch body. Accordingly, the latch slide is moveable between an engaged position where the latch head 106 is in a distal most position relative to the housing and a disengaged position where the latch head is in a proximal most position relative to the housing. The length of the slots allows for movement between the engaged position and the disengaged position. In other words, the slots may have a length greater than or equal to a distance between the engaged position and the disengaged position. As shown in FIG. 4, the latch head 106 is configured as a roller latch with a wheel which is rotatably mounted to the latch slide. The latch slide is linearly coupled to the latch rod 108 which includes male threads 109 configured to engage a transmission of an exit device (e.g., a vertical rod and/or an actuator). The latch rod is configured to move the latch slide between the engaged and disengage position. For example, when coupled to a transmission, activating an exit device (e.g., pushing the push bar) may cause tension to be applied to the latch rod which moves the latch slide to the disengaged/retracted position, thereby releasing the door. As shown in FIG. 4, the latch rod also includes a biasing member 110 configured as a compression spring to return the latch to the extended position upon release of the push bar, for example.

According to the embodiment shown in FIG. 4, the pre-existing latch assembly 100 also includes a latch insert 112 having an insert fastener hole 113 configured to receive a fastener which rotationally secures the pre-existing latch assembly to an associated exit device housing. As shown in FIG. 4, the latch insert may include a flattened portion 111 surrounding the insert fastener hole so that a gap between the latch body and an associated exit device housing is formed. Of course, it should be appreciated that in another embodiment, the latch insert may not include a flattened portion and is instead may be rounded to match the shape of an associated exit device housing.

Figure 5:
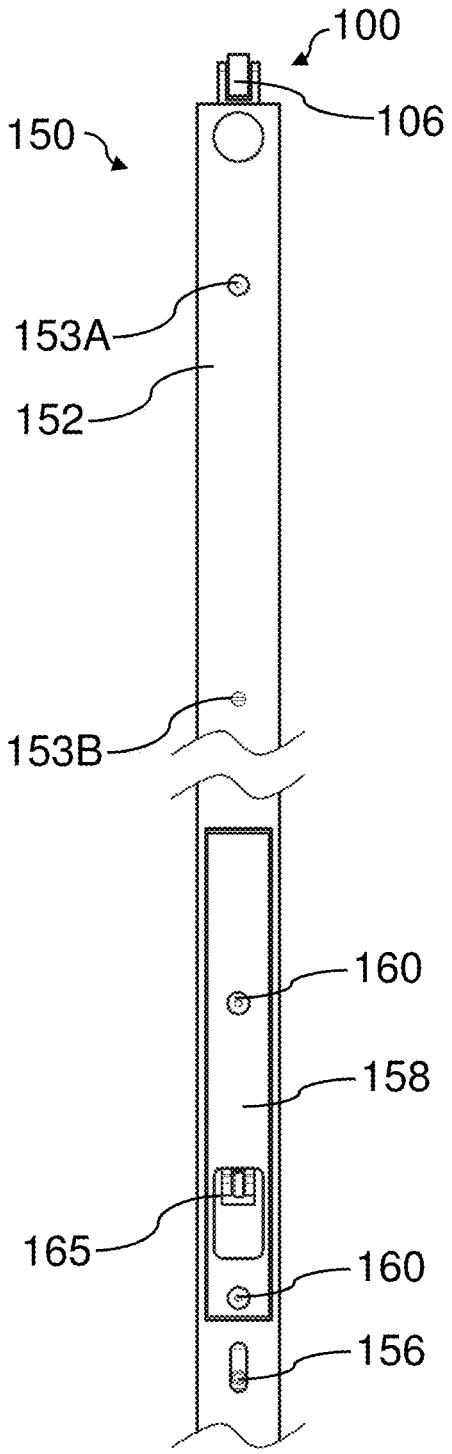
FIG. 5 depicts the pre-existing latch assembly of FIG. 4 disposed in an exit device.

FIG. 5 depicts the pre-existing latch assembly 100 with roller latch head 106 installed in one embodiment of an exit device 150. The exit device includes an exit device housing 152 and a lever arm 165. As shown in FIG. 5, only the roller latch head 106 projects from an exit device housing 152 and is movable to engage or disengage a door strike. The exit device 150 includes a vertical rod (for example, see FIG. 6) which is moveable in the exit device housing to move the latch head from an engaged (i.e., extended) position to a disengaged (i.e., retracted) position. The lever arm 165 is operatively coupled to the vertical rod and is configured to move the vertical rod inside of the exit device housing when an associated actuator is activated. In the embodiment of FIG. 5, the lever arm is configured to move the vertical rod in a proximal direction to move the roller head latch toward the disengaged position. In some embodiments, the lever arm may include an optional wheel configured to contact an associated actuator, which allows the lever arm to reliably engage the actuator while limiting wear on the lever arm and/or actuator.

As shown in FIG. 5, the exit device includes a dog button 156 and a trim plate 158. According to the embodiment of FIG. 5, the dog button 156 is actuable to bias the latch head to a disengaged position. That is, the dog button may prevent the latch head from moving from a disengaged position to the engaged position so that the exit device is prevented from latching. In some embodiments, the disengaged position may correspond with an extended position where the latch head protrudes from the exit device housing and the engaged position may correspond with a retracted position where the latch head is disposed in the exit device housing. The trim plate may be removed to access internal elements of the transmission of the exit device, such as the lever arm 165. The trim plate is fastened to the exit device with two trim plate fasteners 160. According to the embodiment shown in FIG. 5, when the dog button and trim plate are removed a vertical rod of the transmission of the exit device may be moveable so that the pre-existing latch assembly can be slid out of the exit device housing. For example, the dog button may be unscrewed to remove the dog button and the two trim plate fasteners 160 may be unscrewed to remove the trim plate. The exit device housing also includes insert fastener 153A and transmission fastener 153B which may be used to releasably secure the pre-existing latch and/or transmission to the exit device housing.

Figure 6:
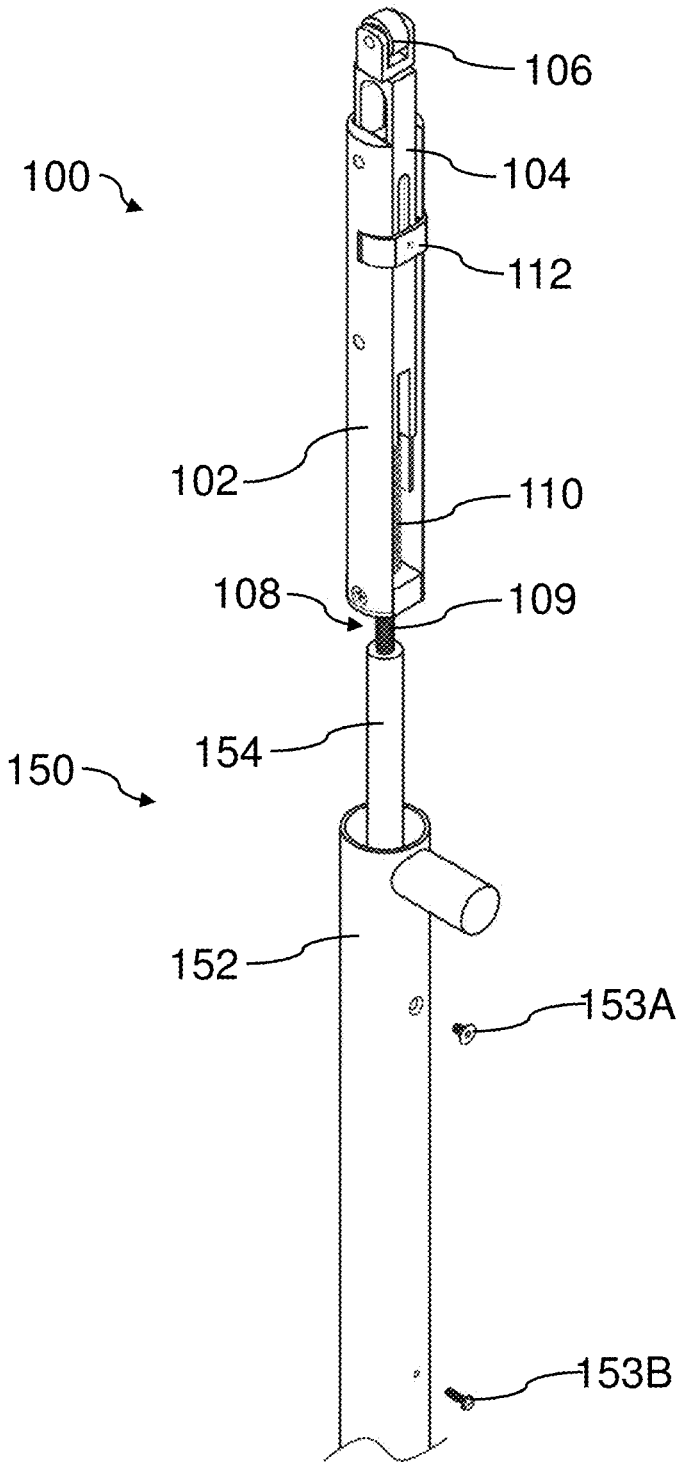
FIG. 6 depicts the pre-existing latch assembly of FIG. 6 during a decoupling process.

FIG. 6 depicts the pre-existing latch assembly and exit device of FIG. 5 during a decoupling process. As discussed previously, the dog button, trim plate, and fasteners 153A, 153B may be removed to allow a transmission of the exit device and/or the pre-existing latch assembly to be slidably and rotationally released from the exit device housing 152. In the state shown in FIG. 6, the pre-existing latch assembly 100 has been rotationally released and the vertical rod 152 has been slidably released from the exit device housing 152. More specifically, the insert fastener 153A and transmission fastener 153B which secure the pre-existing latch assembly and the vertical rod to the exit device housing have been removed. Additionally, the dog button and trim plate (see FIGS. 3 and 5) have been removed to allow the vertical rod 154 of the exit device to be slid at least partially out of the exit device housing. Accordingly, in the position shown in FIG. 6, the pre-existing latch assembly is accessible to an operator who may take further steps to remove the pre-existing latch assembly from the vertical rod and replace it with a retrofit latch adapter. For example, from the position shown in FIG. 6, the pre-existing latch assembly may be rotated to unthread the male threads 109 of the latch rod 108 from the cooperating female threads of the vertical rod 154 to linearly decouple the pre-existing latch assembly from the vertical rod.

As may be appreciated from FIG. 6, linear (i.e., upward and downward) movement of vertical rod 154 forming a part of the transmission of the exit device 150 controls the position of the latch slide 104. The latch slide 104 is configured to slide in the latch body 102 and is coupled to the vertical rod 154 via the latch rod 108. The vertical rod is coupled to a lever arm (for example, see FIG. 3) of the exit device which may be used to move the vertical rod to apply tension to the latch rod to move the latch slide from an engaged position to a disengaged position. In the present embodiment, any suitable vertical rod lever arm or actuator may be employed which is operable by a handle, push bar, push rail, or any other appropriate interface device. As shown in FIG. 6 and discussed previously, the pre-existing latch assembly includes a biasing member 110 arranged as a compression spring which is configured to bias the latch slide toward an engaged position. Accordingly, the biasing member similarly biases the vertical rod in a distal direction so that the latch slide remains in the engaged position until tension is applied to the latch rod from the vertical rod (e.g., by activating the actuator of the exit device).

Figure 7A:
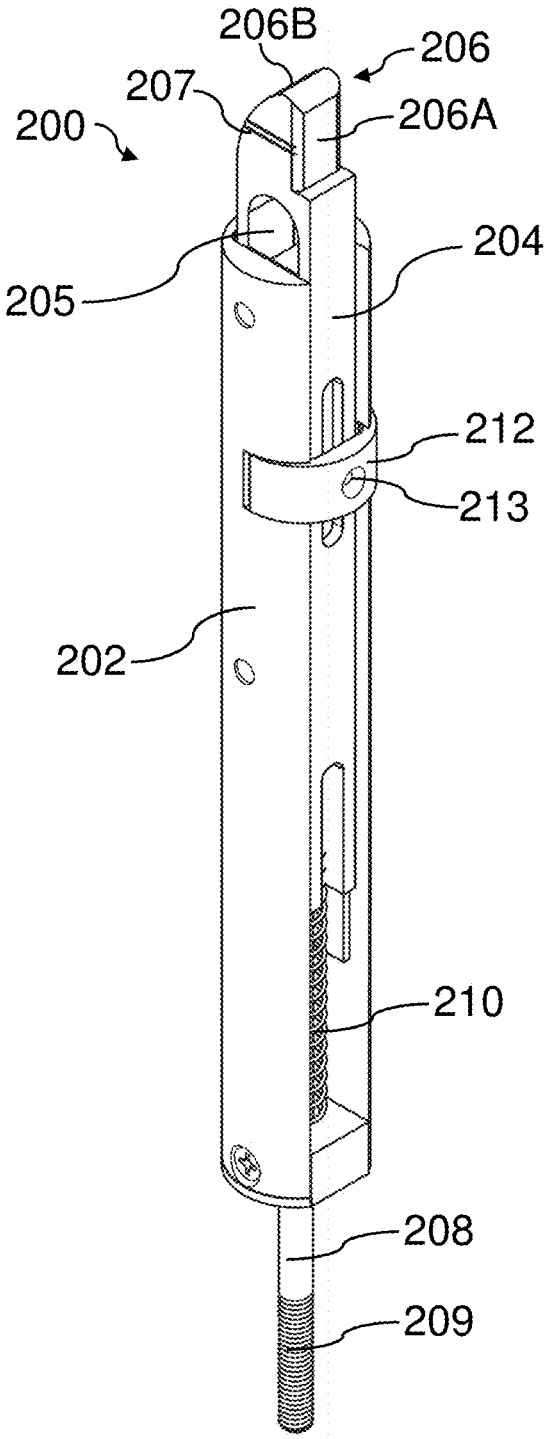
FIG. 7A depicts a perspective view of one embodiment of a retrofit latch adapter.

FIG. 7A depicts a perspective view of one embodiment of a retrofit latch adapter 200 including a latch body 202, a latch slide 204, a latch rod 208, and a biasing member 210. As shown in FIG. 7A, the latch body is configured to house the latch slide and latch rod. The latch body is shaped complementary to the shape of an associated exit device housing so that the latch body may fit closely inside of an exit device housing. Accordingly, the latch body of FIG. 7A is shaped as a cylinder which is configured to fit closely inside a cylindrically tubular exit device housing. Of course, other shapes of the latch body may be employed based on the shape of the associated exit device housing, including, but not limited to, elliptic cylinders, rectangular prisms, and other polygonal prisms, as the present disclosure is not so limited. Similar to the pre-existing latch assembly of FIG. 4, the latch slide 104 is slidably coupled to the latch body by slots 205 and is also coupled to the latch rod 208 which is operable to control the position of the latch slide. The latch slide is moveable between an engaged position corresponding to a distal position and a disengaged position corresponding to a proximal position. In some embodiments, the distal position may be a distal most position and the disengaged position may be a proximal most position. The biasing member 210 is configured as a compression spring which is disposed between the latch body and the latch slide. The spring urges the latch slide toward the engaged position, correspondingly urging the latch rod in the same direction. While the biasing member shown in FIG. 7A is configured as a compression spring, any suitable biasing member may be employed, including extension springs. The latch rod includes male thread 209 which may engage a transmission (e.g., through a vertical rod) of an associated exit device to linearly couple the latch slide to the transmission.

According to the embodiment of FIG. 7A, the retrofit latch adapter includes a latch insert 212. The latch insert 212 includes an insert fastener hole 213 which is configured to receive a suitable fastener, such as a screw or bolt. The latch insert and insert fastener hole are used to rotationally secure the retrofit latch adapter to an associated exit device housing. That is, a suitable fastener extending through a corresponding hole on the exit device housing and the insert fastener hole rotationally secures the latch body 202. Compared with the latch insert of the pre-existing latch assembly shown in FIG. 4, the latch insert 212 of the retrofit latch adapter forms a semicircle with a continuous circumference. Accordingly, the latch insert 212 may fit more closely with an exit device housing than the flattened latch insert of FIG. 3. Such an arrangement may be desirable as the closer fit may result in a more secure fit with a lesser amount of play (i.e., lash).

According to the embodiment shown in FIG. 7A, the latch slide includes a latch head 206 which, in contrast to the pre-existing latch assembly of FIG. 4, is configured as a flat latch. That is, the latch head includes a flat portion 206A and a strike portion 206B. As shown in FIG. 7A, the flat portion defines a plane, whereas the strike portion is curved or otherwise inclined. Accordingly, the flat portion will resist forces without urging the latch slide toward the disengaged position. The strike portion, due to its curved inclined shape, urges the latch slide toward the disengaged position (e.g., when the strike portion contacts a door strike plate). Thus, rather than the roller latch shown in FIG. 4, the flat latch head offers additional security and force resistance for a door in at least one direction. Additionally, the flat portion of the latch head may resist biding, making the retrofit latch adapter less susceptible to bypass attempts. As shown in FIG. 7A, the latch head includes indicia configured as two lines which may be used by an operator to determine a suitable amount of protrusion of the latch head from an associated exit device.

Figure 7B:
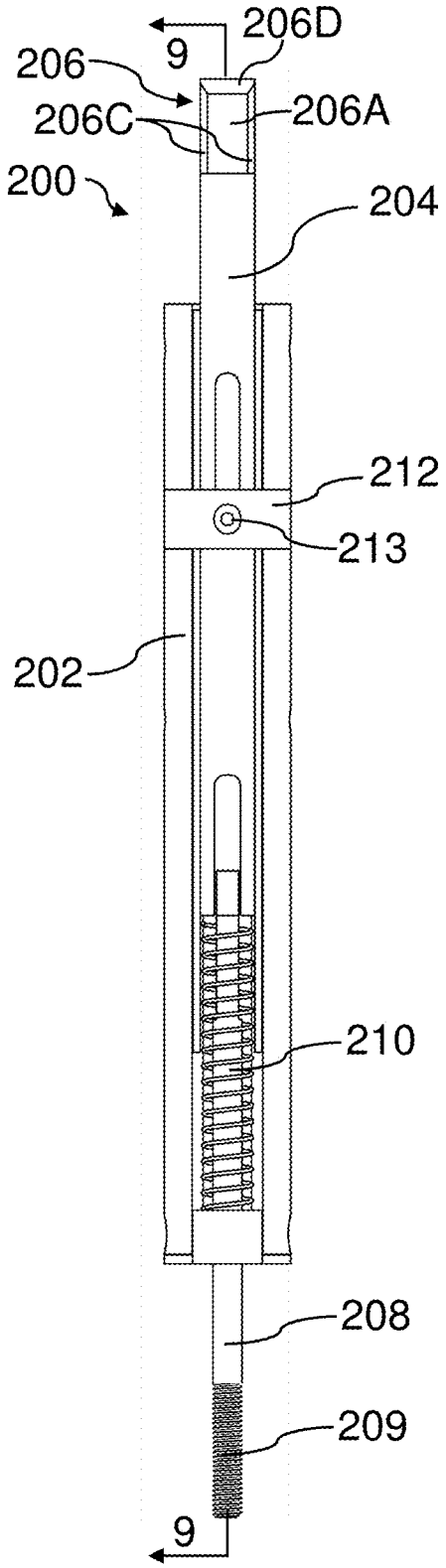
FIG. 7B depicts a front view of the retrofit latch adapter of FIG. 7A.

FIG. 7B depicts a front view of the retrofit latch adapter 200 of FIG. 7A. As best shown in FIG. 7B, the latch head 206 includes opposite sides 206C between the flat portion 206A and the angled or non-flat strike portion 206B (see FIG. 7A). The opposite sides 206C are configured as beveled edges along the flat portion. When the latch slide is in the engaged position and extends into an associate strike plate, the beveled edges 206C prevent point contact with the inside of the strike plate opening and reduce the force used to retract the latch slide when the latch head flat portion 206A is in contact with the inside of the strike plate opening. Such an arrangement may be desirable over conventional straight or "squared-off" edges typically used in latch heads which can cause the latch head to dig into the sides of the strike plate opening if force is applied to the door while the latch is engaged. The latch head also includes a transition surface 206D which smoothly transitions from the strike portion (see FIG. 7A) and the flat portion. That is, there are no sharp angles between the strike portion and the flat portion. Such an arrangement may be desirable to reduce opening and/or closing force as the latch head extends into an opening of an associated strike plate.

Figure 8:
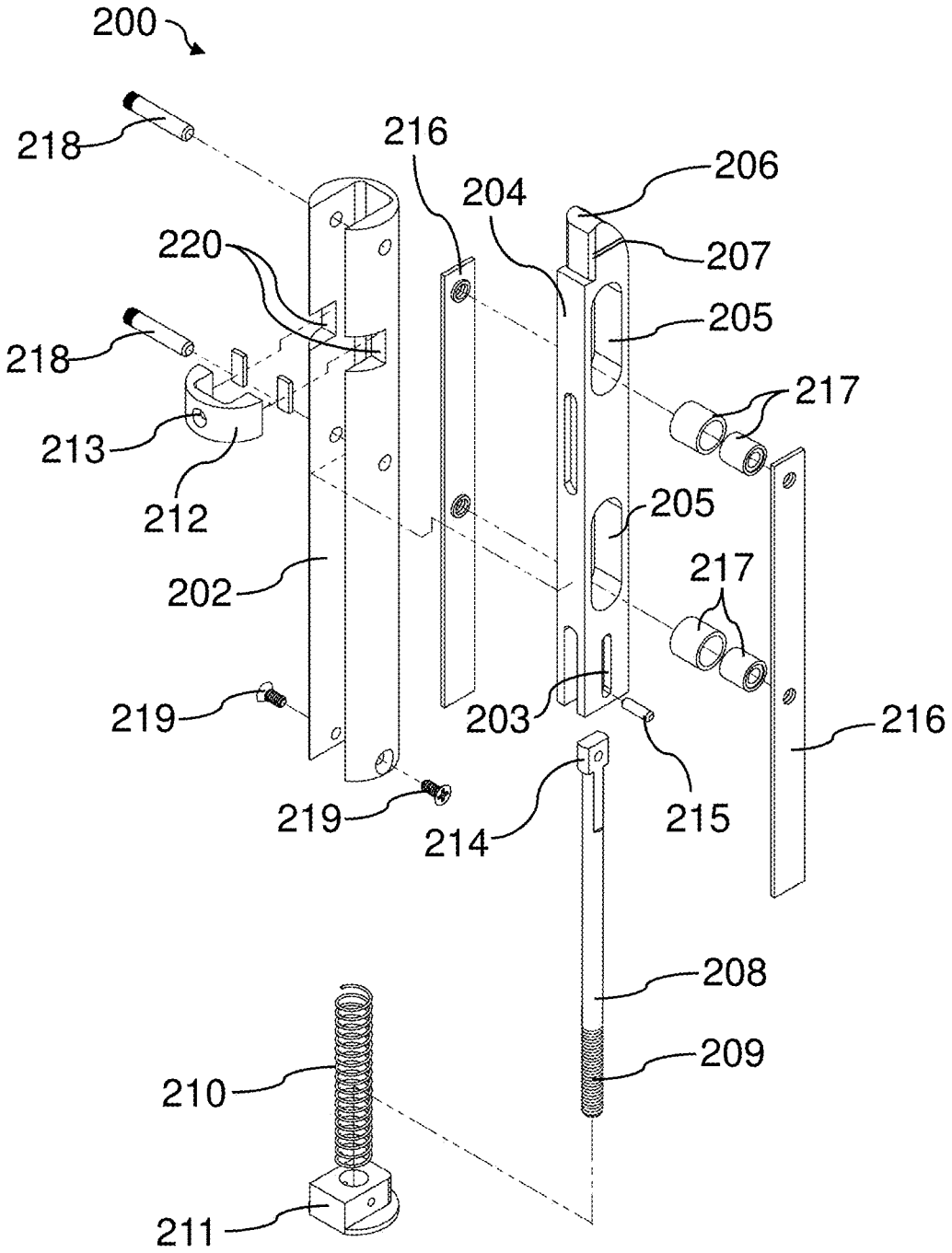
FIG. 8 depicts an exploded view of the retrofit latch adapter of FIG. 7A.

FIG. 8 is an exploded view of the retrofit latch adapter 200 of FIG. 7A. As best shown in FIG. 8, the retrofit latch adapter includes a latch body 202, latch slide 204, latch rod 208, spring 210, and latch insert 212 which are combined with various connecting elements to form the retrofit latch adapter. In particular, the latch slide is slidably connected to the latch body by two latch slide pins 218 which extend through slots 205 formed in the latch slide. The latch slide pins 218 pass through longitudinal spacers 216 and slot rollers 217 which ensure that the latch slide can slide within the latch body with suitably low friction and wear. The latch slide is coupled to the latch rod 208 through a latch rod pin 215 which passes through a latch rod head 214 and latch rod slot 203. Accordingly, in the embodiment of FIG. 8, the latch rod is slidably coupled to the latch slide. The spring 210 receives the male threads 209 of the latch rod so that the latch rod is surrounded by the spring. A latch body cap 211 similarly receives the latch rod 208 and is configured to guide the latch rod as well as abut and resist force from the spring. The latch body cap is secured to the latch body with two cap fasteners 219 which hold the spring in place, allowing the spring to urge the latch slide toward an engaged position.

As best shown in FIG. 8, the latch insert 212 is not physically connectable to the latch body 202. The latch insert fits into insert slots 220 which are shaped to correspond with the shape of the latch insert. However, in the embodiment of FIG. 8, there are no direct connections between the latch insert and the latch body. Instead, the latch inset is placed into the insert slots and held there by friction until the retrofit latch adapter is inserted into an associated exit device housing. Once in the exit device housing, the latch insert is held in contact with the latch body by the exit device housing. When the latch insert is secured to the exit device housing (e.g., by an insert fastener engaging threaded hole 213), the latch insert contacts the insert slots 220 to resist rotation of the retrofit latch adapter, thereby rotationally securing the retrofit latch adapter.

Figure 9:
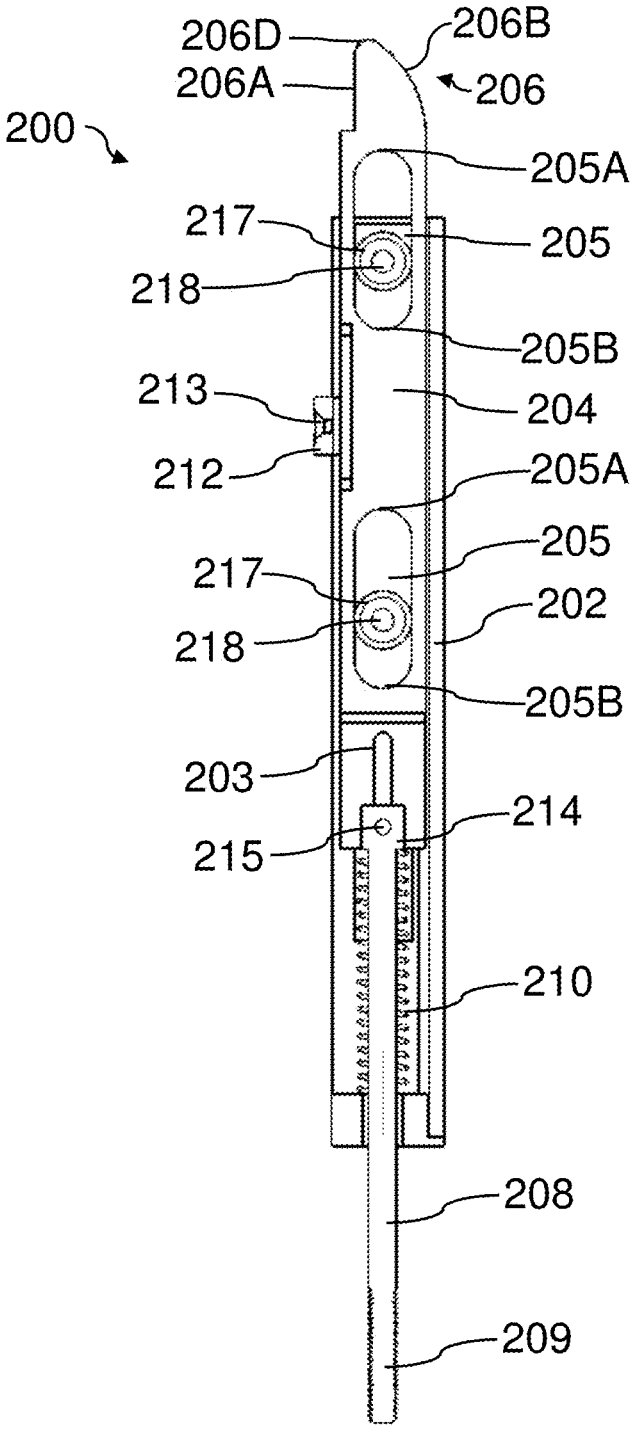
FIG. 9 is a cross-sectional view of the latch adapter of FIG. 7A taken along line 9-9 of FIG. 7B.

FIG. 9 is a cross-sectional view of the latch adapter 200 of FIG. 7A taken along line 9-9 of FIG. 7B which best shows the operation of the retrofit latch adapter. As discussed previously, the retrofit latch adapter includes a latch body 202, latch slide 204, latch rod 208, spring 210, and latch insert 212. The latch slide is slidably coupled to the latch body by latch slide pins 218 and slot rollers 217. The latch slide is moveable between an engaged position corresponding to a distal most position and a disengaged position corresponding to a proximal most position. More specifically, when the slot rollers 217 are in contact with or are otherwise near a proximal portion 205B of the slots 205 the latch slide is in an engaged position. Conversely, when the slot rollers 217 are in contact with or are otherwise near a distal portion 205A of the slots 205 the latch slide is in the disengaged position. Accordingly, in the position shown in FIG. 9, the latch slide is approximately midway between the engaged position and disengaged position. Of course, in some embodiments, the engaged position and disengaged position may be determined by a distance which the latch slide projects out of an associated exit device housing or any other suitable metric, as the present disclosure is not so limited.

As shown in FIG. 9 and discussed previously, the latch rod 208 is coupled to the latch slide 204 and is moveable to correspondingly move the latch slide between the engaged position and the disengaged position. The latch rod is coupled to the latch slide by a latch rod pin 215 which extends through a latch rod head 214 as well as a latch rod slot 203 in the latch slide. Accordingly, the latch rod is slidable relative to the latch slide and may only apply force to the latch slide when the latch rod pin is in contact with an end of the latch rod slot. In the embodiment of FIG. 9, the latch rod is configured to apply a tensional force to the latch slide which moves the latch slide to the disengaged position. The latch rod does not need to provide a pushing (i.e., distal force) on the latch slide, as the spring 210 urges and returns the latch slide to an engaged position. Thus, in the configuration shown in FIG. 9, the latch rod pin may primarily remain in contact with a proximal portion (i.e., lower portion) of the latch rod slot. When tensional force is applied to the latch rod (e.g., through male threads 209) the latch rod applies a proximal force to the latch slide which moves the latch slide toward the disengaged position against the resistance of the spring 210.

Figure 10:
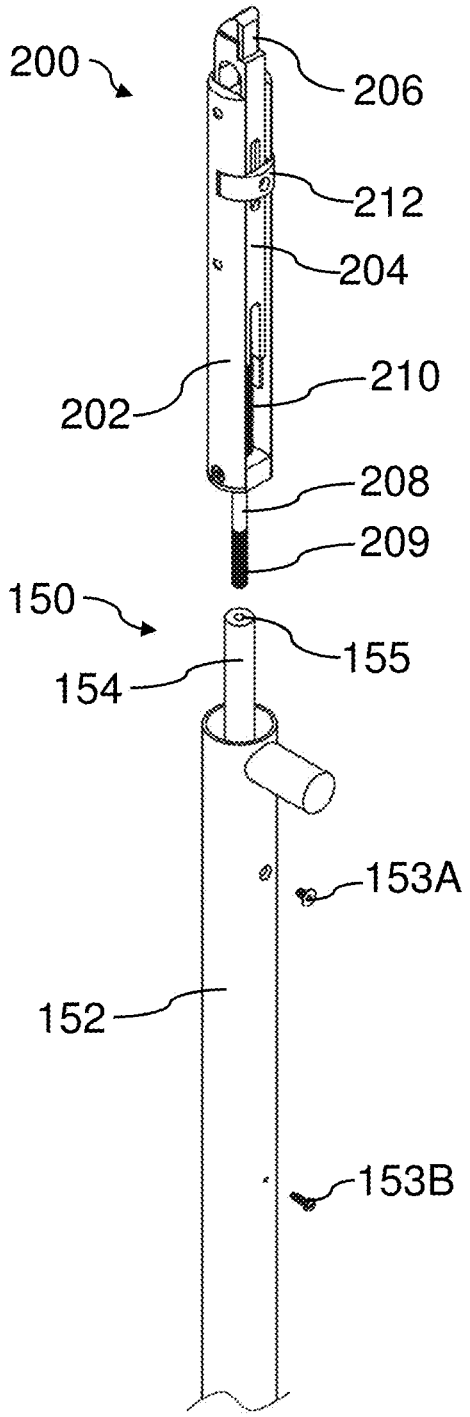
FIG. 10 depicts the retrofit latch adapter of FIG. 7A during an installation process.

FIG. 10 depicts the retrofit latch adapter 200 of FIG. 7A during an installation process into a pre-existing exit device 150. As shown in FIG. 10, the exit device is the same as the exit device shown in FIGS. 5-6. In the state shown in FIG. 10, a pre-existing latch assembly (for example, see FIGS. 4-6) has been removed from the exit device. An insert fastener 153A and a transmission fastener 153B have been removed from the exit device housing 152. Other components of the exit device, such as a dog button, trim plate, trim plate fasteners, and any other components have been similarly removed so that a vertical rod 154 of the exit device is slidable within the exit device housing 152. As discussed previously, the vertical rod forms a part of the transmission of the exit device which transmits force from an actuator to the installed pre-existing latch assembly or retrofit latch adapter. As shown in FIG. 10, the vertical rod 154 has been moved at least partially out of the exit device housing 152. The vertical rod includes female threads 155 which are configured to receive the male threads 209 of the retrofit latch adapter. Accordingly, from the state shown in FIG. 10, the latch adapter may be rotated to thread the male threads into the female threads of the vertical rod and linearly couple the retrofit latch adapter to the vertical rod.

Figure 11:
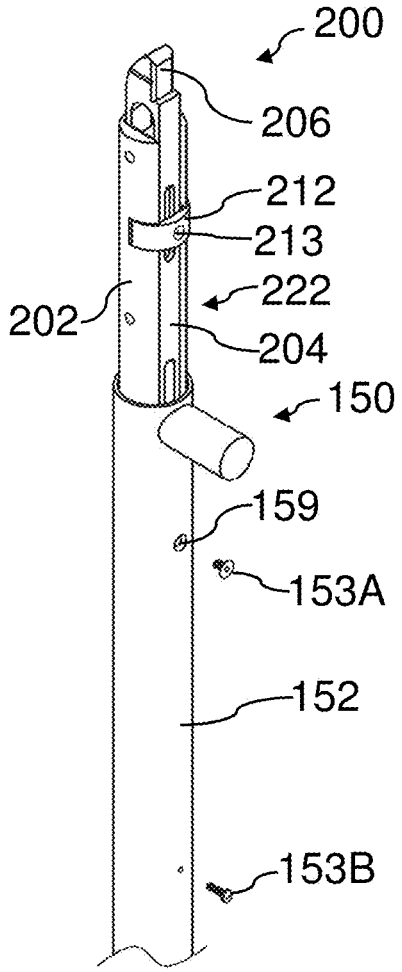
FIG. 11 depicts the retrofit latch adapter of FIG. 7A during an installation process.

FIG. 11 depicts the retrofit latch adapter 200 of FIG. 7A during an installation process following the stage of the process shown in FIG. 10. After the retrofit latch adapter is threaded into the female threads 155 of the vertical rod 154, the retrofit latch adapter and vertical rod are inserted into the exit device housing 152. As best shown in FIG. 11, the latch body 202 fits closely with the exit device housing. That is, the exit device housing is configured as a cylindrical tube and the exit device housing has a cylindrical shape which fit together in a tight or sliding clearance fit. According to the embodiment shown in FIG. 11, the retrofit latch adapter is inserted into the exit device housing until the insert hole 213 of the latch insert 212 aligns with a fastener hole 159 on the exit device housing. Once the insert hole is aligned with the insert fastener hole 159, an insert fastener 153A may be inserted to rotationally secure the latch adapter to the exit device housing.

In some cases, internal mounting components of the exit device housing may interfere with the insertion of the retrofit latch adapter into the exit device housing. Accordingly, in some embodiments, the retrofit latch adapter may be turned approximately 90 degrees from a final installation position as the retrofit latch adapter is inserted into the exit device housing, and then turned in a reverse direction approximately 90 degrees to return to the final installation position. By turning the retrofit latch adapter approximately 90 degrees, additional clearance may be afforded to internal hardware of the exit device housing by aligning a flattened portion 222 of the retrofit latch adapter with the internal hardware. The flattened portion may be configured as a circular segment which is removed from an otherwise cylindrical shape. That is, the retrofit latch adapter latch body may be substantially cylindrical but have a flat side forming the flattened portion. Accordingly, when placed in a cylindrical tube (e.g., an exit device housing), the flattened portion may be spaced from an internal wall of the cylindrical tube, thereby providing clearance for any internal hardware which may be projecting from the internal wall of the cylindrical tube. In some embodiments, the retrofit latch adapter may be inserted partially into the exit device housing, rotated approximately 90 degrees in a first direction, inserted further into the exit device housing, and rotated approximately 90 degrees in a second direction opposite the first direction. This installation process may allow certain elements of the latch insert and any internal mounting hardware to clear one another in sequence. In some embodiments, the retrofit latch adapter may include slots, channels, grooves, or other suitable shapes configured to accommodate internal hardware of the exit device housing.

In some embodiments, internal hardware of an exit device housing may be positioned at various angular positions in the exit device housing. Accordingly, when the retrofit latch adapter is inserted into the exit device housing, the retrofit latch adapted may be rotated from a final installation position by an angular rotation of about 10 degrees, about 20 degrees, about 45 degrees, about 90 degrees, about 135 degrees, about 180 degrees, and/or any other appropriate amount of rotation needed to clear the internal mounting hardware. Combinations of these angular displacements are contemplated including, for example, a rotation between or equal to 45 degrees and 90 degrees, 90 degrees and 180 degrees, as well as 45 degrees and 135 degrees. Of course it should be understood that other possible combinations of the above noted ranges, as well as ranges both greater than and less than those noted above, are also contemplated.

Figure 12:
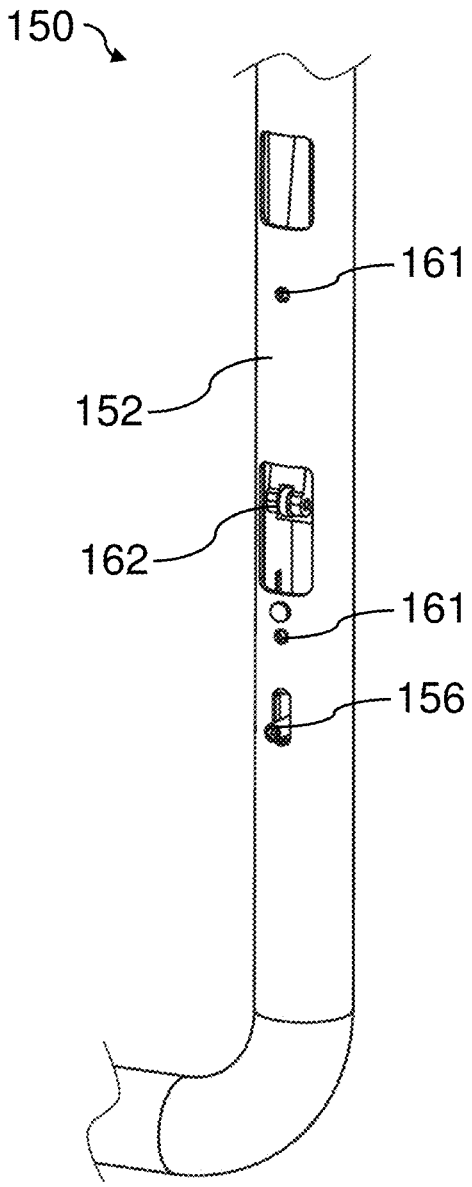
FIG. 12 depicts one embodiment of an exit device during an installation process of a retrofit latch adapter.

FIG. 12 depicts one embodiment of an exit device 150 during an installation process of a retrofit latch adapter. FIG. 12 shows a lower portion of the exit device which houses transmission components of the exit device. As discussed previously, the exit device 150 includes a dog button 156 and a trim plate (for example, see FIG. 5) which has been removed from the exit device housing. Trim plate fasteners have been removed from trim plate holes 161 formed in the exit device housing 152. With the trim plate removed, an actuator 162 of the exit device is clearly shown. According to the embodiment shown in FIG. 12, the actuator is configured to move the vertical rod (see FIG. 10) in a proximal direction to apply tension to an attached latch rod of a pre-existing latch assembly or retrofit latch adapter. As shown in FIG. 12, the dog button 156 has been replaced (e.g., rethreaded into the transmission) after the vertical rod and retrofit latch adapter have been inserted into the exit device housing. That is, the dog button may impede the vertical rod from being slid out of the exit device housing (e.g., as shown in FIG. 10). Accordingly, the dog button may be replaced after the vertical rod and retrofit latch adapter have been at least partially inserted into the exit device housing. After the dog button has been replaced, the trim plate may be replaced on the exit device housing and fastened with trim plate fasteners through trim plate holes 161.

Figure 13:
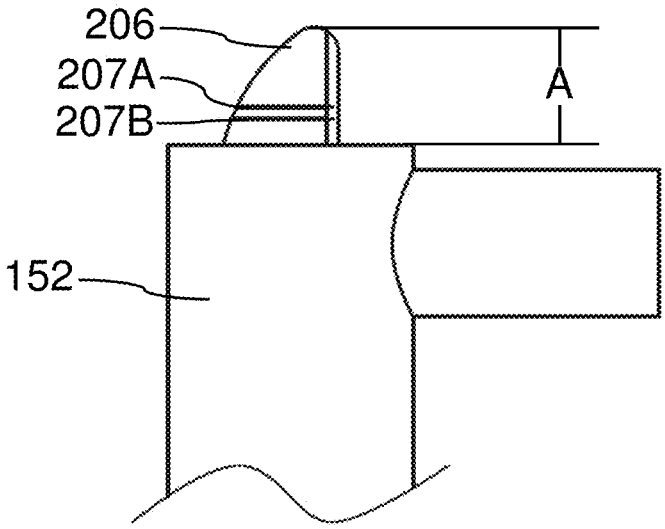
FIG. 13 depicts a latch head of the retrofit latch adapter of FIG. 7A and an exit device.

FIG. 13 depicts a latch head 206 of the retrofit latch adapter of FIG. 7A and an exit device housing. As shown in FIG. 13, the latch head projects out of the exit device housing a distance A. The distance A may determine how well the latch head engages with a door strike, so that the exit device has a suitable actuation force and an associated door may be reliably secured. For example, if the distance A is too great, the latch head may extended further than a pocket of the door strike is deep and may therefore jam or otherwise induce additional frictional forces when the exit device is operated. Conversely, if the distance A is too small, the latch head may not sufficiently engage to door strike to secure the door. Accordingly, in the embodiment shown in FIG. 13, the distance A is adjustable by adjusting the amount the retrofit latch adapter is threaded into the vertical rod (for example, see FIG. 10). In the embodiment of FIG. 13, the retrofit latch adapter may be rotated to adjust the distance A to approximately 0.75". Correspondingly, the male threads of the latch rod may be threaded into the female threads of the vertical rod between or approximately equal to 0.75" and 1". Of course, the distance A may be determined by any suitable amount of threading of the latch rod into the vertical rod, as the present disclosure is not so limited. According to the embodiment shown in FIG. 13, after the distance A is set by rotation of the retrofit latch adapter, an insert fastener may be used to rotationally secure the retrofit latch adapter and complete the installation process.

In some embodiments, the distance A may be adjusted to any suitable distance for engaging an associated door strike. Accordingly, distance A may be greater than or equal to 0.5", 0.75", 1" and/or any other appropriate distance. Correspondingly, distance A may be less than or equal to 1", 0.75", 0.5", and/or any other appropriate distance. Combinations of these distances are contemplated including, for example, distances between or equal to 0.5" and 0.75", 0.5" and 1", as well as 0.75" and 1". Of course it should be understood that other possible combinations of the above noted ranges, as well as ranges both greater than and less than those noted above, are also contemplated.

According to the embodiment shown in FIG. 13, the latch head includes two indicia configured as lines 207A, 207B on the latch head. The indicia are configured to convey information to an operator (e.g., an installer) of the exit device and/or retrofit latch adapter. In some embodiments, the indicia convey suggested minimums and maximums for adjusting the distance A. The lines may be aligned with a distal most (e.g., uppermost) portion of the exit device housing 152 so that the operator knows whether the distance A is suitable for latch engagement. When the upper line 207A is aligned with a distal most portion of the exit device housing, the latch head may project a minimum suggested distance A. When the lower line 207B is aligned with the distal most portion of the exit device housing, the latch head may project a maximum suggested distance A. The minimum suggested distance may be approximately equal to 0.625" and the maximum distance may be approximately equal to 0.875". Of course, the indicia may correspond to any suitable suggested minimum distance A and suggested maximum distance A, as the present disclosure is not so limited.

Figure 14A:
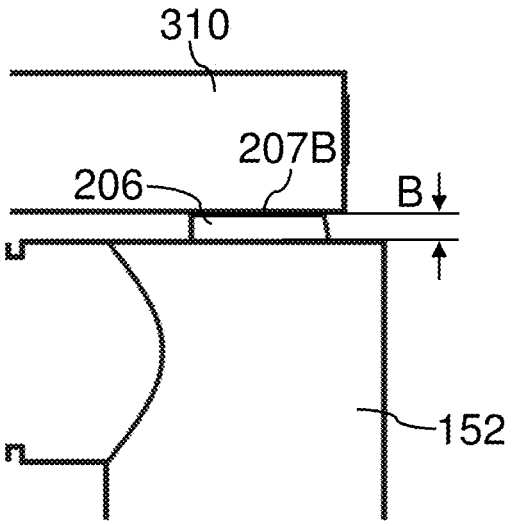
FIGS. 14A-14B depicts an embodiment of a latch head and a door strike.
Figure 14B:
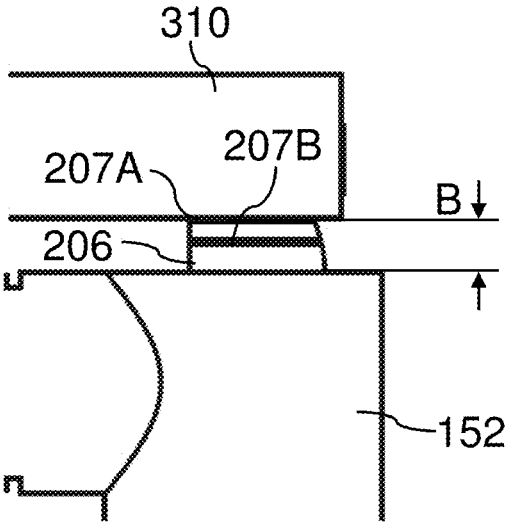

FIGS. 14A-14B depict another embodiment of a latch head 206 including indicia configured as lines 207A, 207B which convey information to an operator of the exit device. As shown in FIGS. 14A-14B, the latch head 206 protrudes from a distal most portion of an exit device housing 152 into a door strike 310. The door strike captures the latch head to secure a door. According to the embodiment of FIGS. 14A-14B, the latch bolt head includes two indicia lines similar to the embodiment of FIG. 13. In contrast to the embodiment of FIG. 13, the indicia lines in the embodiment of FIGS. 14A-14B are configured to convey information regarding how far the latch bolt head protrudes into the door strike. That is, the lines may be aligned with a door strike so that a suitable amount of protrusion into the door strike may be set. The lines may similarly convey a suggested maximum and minimum distance to an operator for protrusion into the door strike. As shown in FIG. 14A, lower line 207B is aligned with the door strike, indicating a suggested maximum amount of protrusion into the door strike. As shown in FIG. 14B, an upper line 207A is aligned with the door strike, indicating a suggested minimum amount of protrusion into the door strike. Thus, the indicia may be configured to indicate a suggested amount of protrusion into the door strike so that an operator can easily adjust a retrofit latch adapter for effective latching.

According to the embodiment shown in FIGS. 14A-14B, the door strike 310 and the exit device housing 152 may be separated by a distance B which the latch head 206 spans to engage the door strike. The distance B may be at least partly determinative of the distance which the latch head protrudes into the door strike and/or protrudes from a distal most portion of the exit device housing. Accordingly, the exit device may be adjusted based at least partly on the distance B. In some embodiments, the distance B is between or approximately equal to 0.125" and 0.25".

Figure 15:
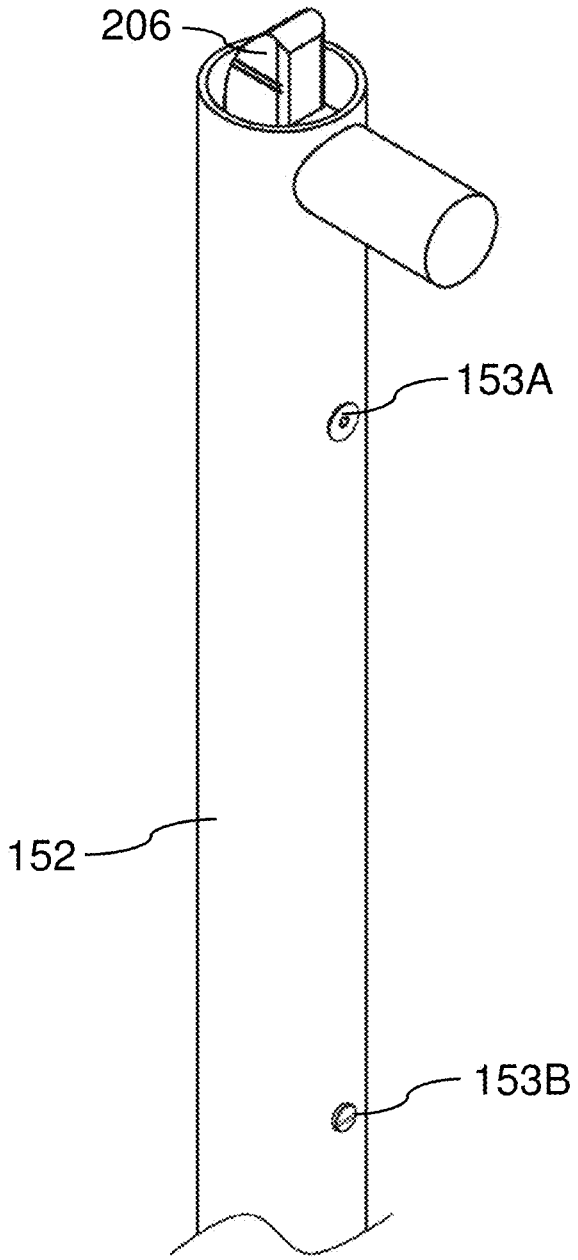
FIG. 15 depicts the retrofit latch adapter of FIG. 7A at the completion of an installation process.

FIG. 15 depicts the retrofit latch adapter of FIG. 7A at the completion of an installation process into an exit device 150. As shown in FIG. 15, the latch insert fastener 153A has been replaced to rotationally secure the retrofit latch adapter in the exit device housing 152. Additionally, the transmission fastener 153B has been replaced to slidably secure a vertical rod of the transmission of the exit device to the exit device housing. The latch head 206 of the retrofit latch adapter protrudes out of the exit device housing and is configured to engage a door strike to secure a door on which the exit device is mounted. As discussed previously, the flat latch head is mechanically linked to the transmission of the exit device so that the exit device is operable to move the latch head between an engaged position and a disengaged position. Accordingly, the exit device shown in FIG. 15 is operable to selectively secure a door.

Figure 16:
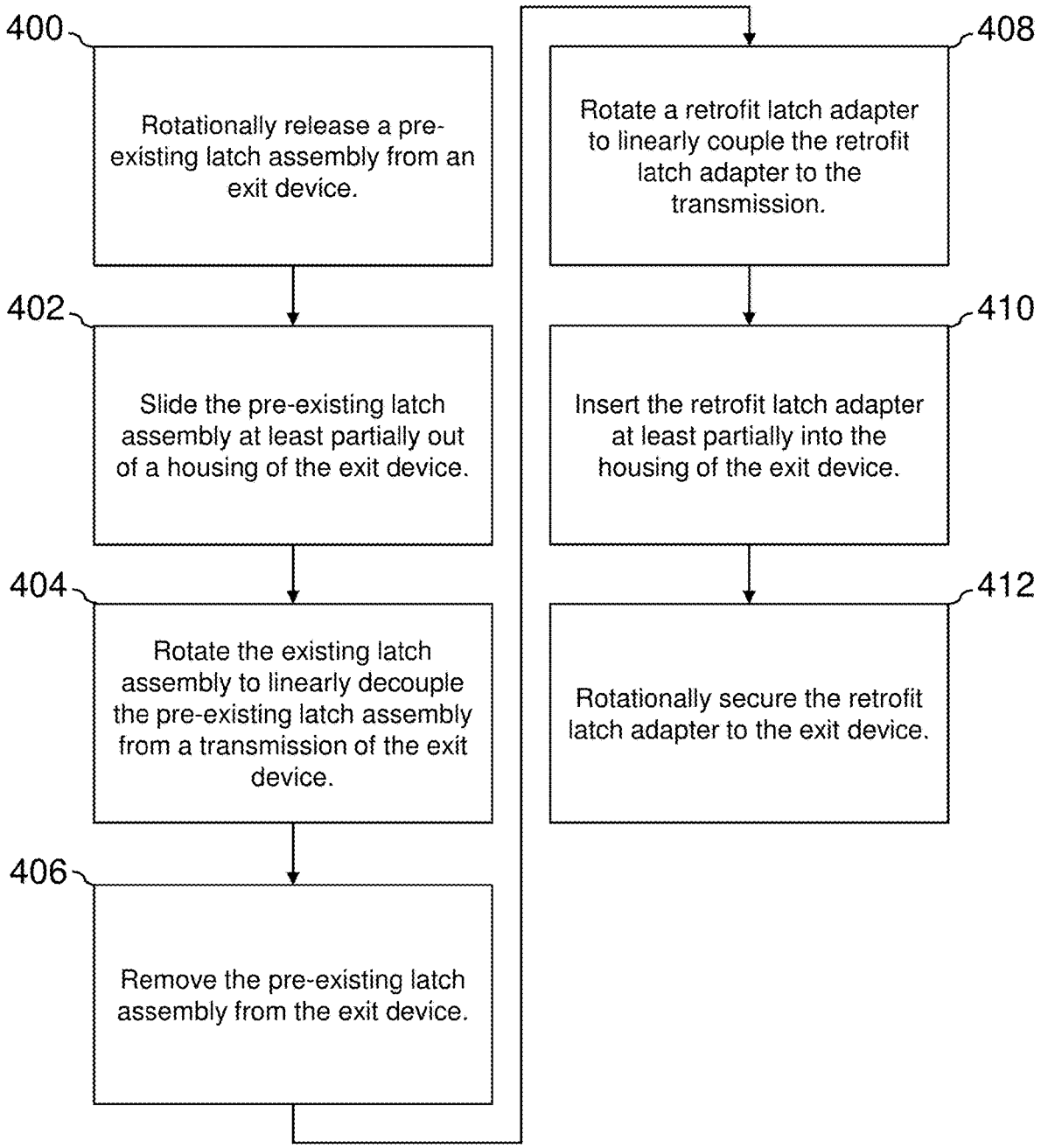
FIG. 16 is a block diagram for one embodiment of an installation process of a retrofit latch adapter.

FIG. 16 is a block diagram for one embodiment of an installation process. At block 400, a pre-existing latch assembly is rotationally released from an exit device. Rotationally releasing a pre-existing latch assembly may include removing a latch insert fastener from an exit device housing. At block 402, the transmission may be at least partially released from an exit device housing and the transmission and pre-existing latch assembly may be slid at least partially out of the exit device housing. At block 404, the pre-existing latch assembly is rotated to linearly decouple to the pre-existing latch assembly from a transmission of the exit device. Linearly decoupling the pre-existing latch assembly may include unthreading a latch rod of the pre-existing latch assembly from the transmission. At block 406, the pre-existing latch assembly is removed from the exit device. In some cases, the pre-existing latch assembly may be positioned outside of an exit device housing as the pre-existing latch assembly is linearly decoupled, in which case the steps in blocks 404 and 406 may be combined. At block 408, a retrofit latch adapter may be rotated to linearly couple the retrofit latch adapter to the transmission. The retrofit latch adapter may be linearly coupled by threading male threads of a latch rod into female thread of the transmission. At block 410, the retrofit latch is inserted at least partially into the exit device housing. At block 412, the retrofit latch adapter is rotationally secured to the exit device. The retrofit latch adapter may be rotationally secured by a latch insert fastener which is inserted through the exit device housing to prevent rotation of the retrofit latch adapter.

Referring now to FIGS. 17-20, an embodiment of a latch slide is shown. As shown in FIGS. 17-20, the latch slide 20 comprises a latch slide 10 engageable with an actuator device mounted on a door (not shown) for moving the latch slide or slide toward or away from a strike plate, as well as a latch head 12 extending from the latch slide. Latch slide 10 is adjustable with respect to the door to adjust the extension or projection distance toward the strike plate. Latch head 12 includes an angled or non-flat sweep side (i.e., strike portion) 40 for contacting the outside surface of the strike plate to cause retraction of the latch head away from the strike plate as the door is closing, and an opposite face (i.e., flat portion) 30 for contacting the inside of an opening in a face of the strike plate to prevent the door from opening when the latch head 12 is extended into the strike plate opening. In an embodiment, face 30 may be flat or otherwise planar. As shown in FIGS. 17-20, the sweep side (i.e., strike portion) 40 is rounded or curved, but it should be understood by those skilled in the art than any otherwise non-flat surface on the sweep side (i.e., strike portion) of the latch head is also contemplated.

Typically, the depth of latch projection into the strike is set before a door is installed and final adjustments may require the door to be taken down and re-adjusted, then installed again. Installation and proper engagement between the latch head and strike can be problematic, particularly in latch bodies used in exit devices for glass doors. If the latch head protrudes too far into the strike, too much force may be used to retract the latch. Conversely, if the latch head does not protrude far enough into the strike, it may be possible to open the door even if the latch is not retracted.

Figure 17:
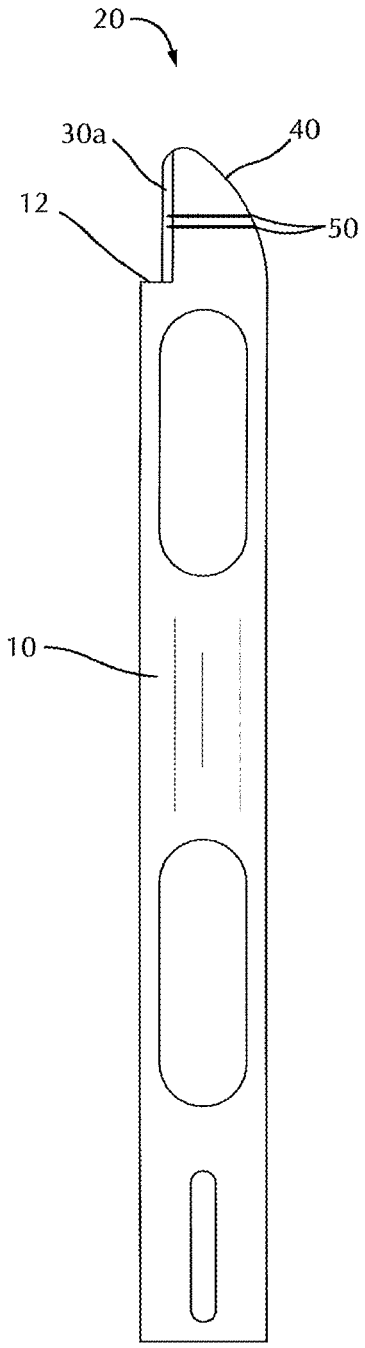
FIGS. 17 and 18 are side plan views of an embodiment of a latch slide.
Figure 18:
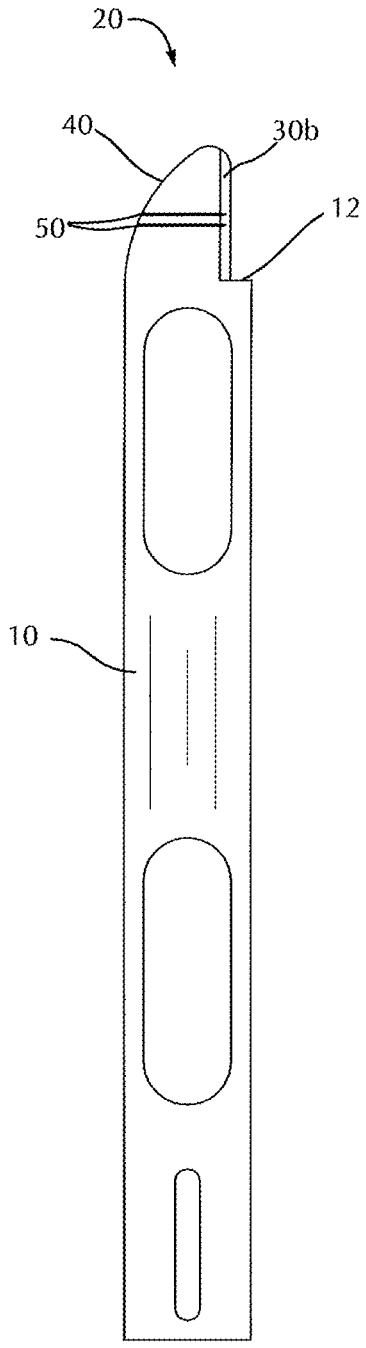
Figure 19:
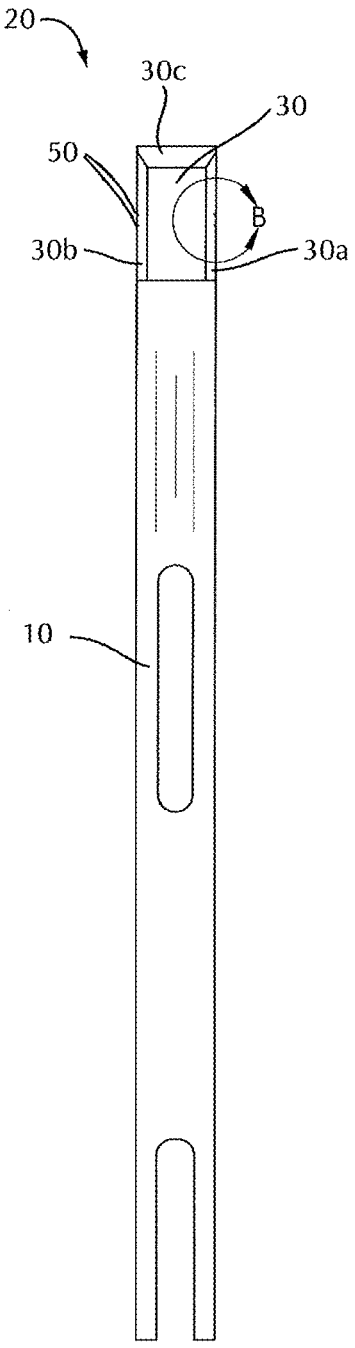
FIG. 19 is a front plan view of the latch slide of FIGS. 17-18.
Figure 20:
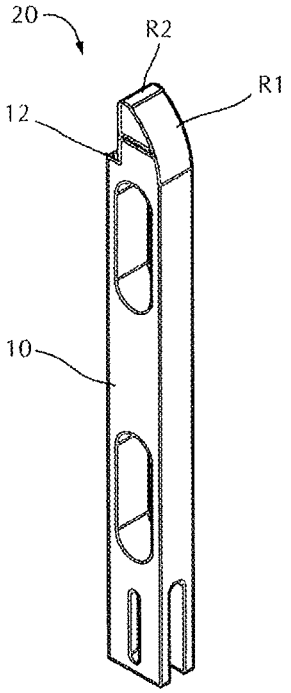
FIG. 20 is a perspective view of the latch slide of FIGS. 17-18.
Figure 21:
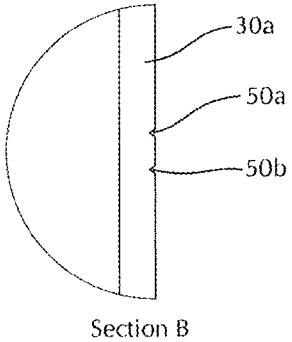
FIG. 21 is a magnified plan view of Section B of FIG. 19.
Figure 22:
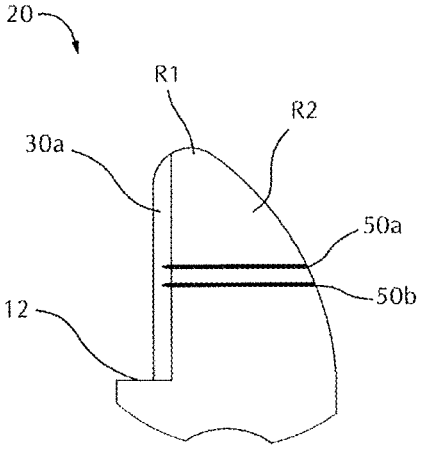
FIG. 22 is a side plan view of an embodiment of a latch head.
Figure 23:
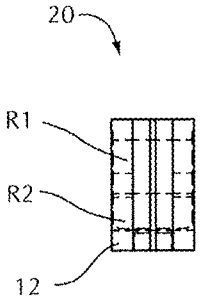
FIGS. 23 and 24 are top plan views of the latch head of FIG. 22.
Figure 24:
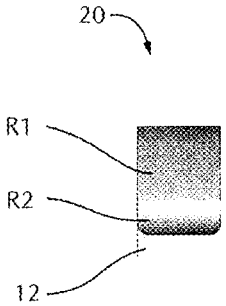

In some embodiments, a latch slide facilitates installation and proper engagement between the latch head and strike plate by including a visual indicator (i.e., indicia) to aid an operator (e.g., an installer). As shown in FIGS. 17 and 20, and more particularly in FIG. 22, latch head 12 comprises a pair of indicia 50*a*, 50*b* visible on at least one side thereof. As shown, indicia 50*a*, 50*b* may comprise a set of parallel lines extending perpendicular to the direction of movement of the latch slide 10. Indicia 50*a* may represent a minimum suggested distance for extension or protrusion of the latch head 12 into the strike plate opening, and indicia 50*b* may represent a maximum suggested distance for extension or protrusion. In one embodiment, indicia 50*a*, 50*b* may be etched or engraved into the side of latch head 12. In other embodiments, indicia 50*a*, 50*b* may be printed or otherwise inscribed onto a side surface of the latch head, such that the indicia are clearly visible to the installer.

According to the embodiment shown in FIGS. 17-20, adjustment of the latch slide with respect to the actuator device comprises visually extending the latch head 12 into the strike plate opening, moving the latch slide 10 toward or away from the strike plate until the face of the strike plate is between the pair of indicia 50*a*, 50*b* on the latch head, and setting the latch slide 10 with respect to the actuator device such that, when extended, the latch head 12 maintains the face of the strike plate between indicia 50*a*, 50*b*.

Figure 25:
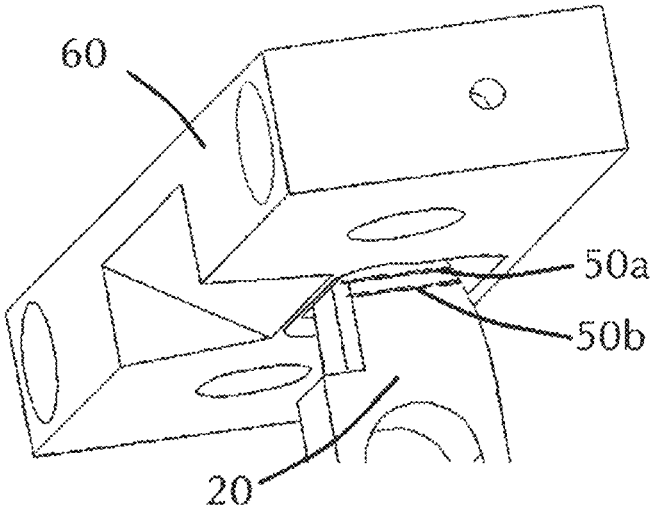
FIGS. 25-28 show an embodiment of the latch head in various states of engagement with a strike plate in a door jamb.
Figure 26:
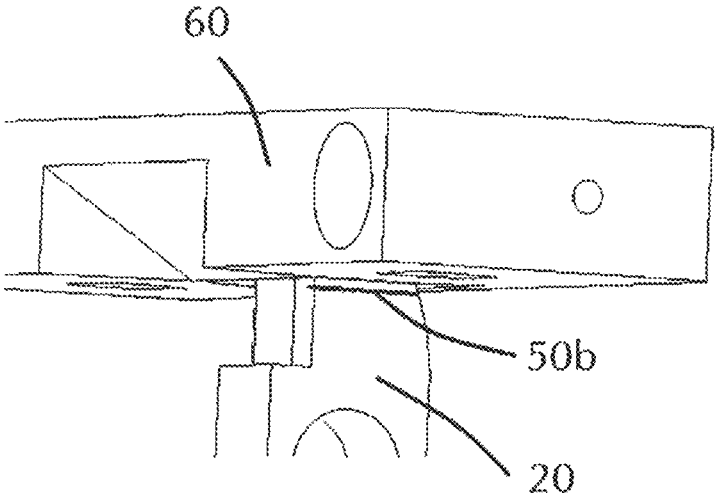
Figure 27:
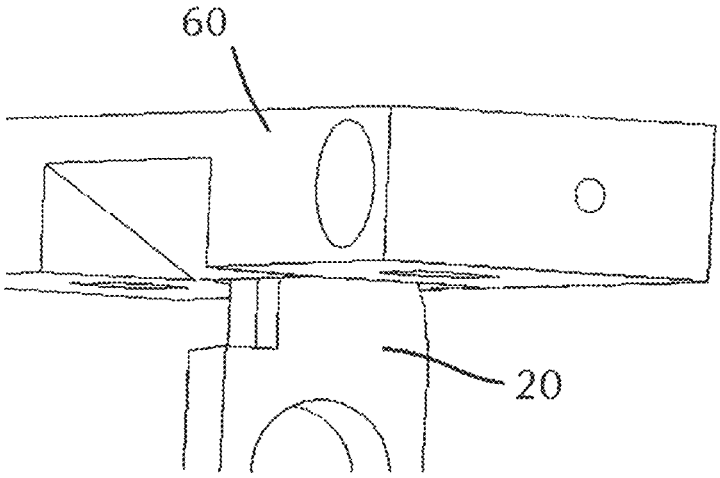
Figure 28:
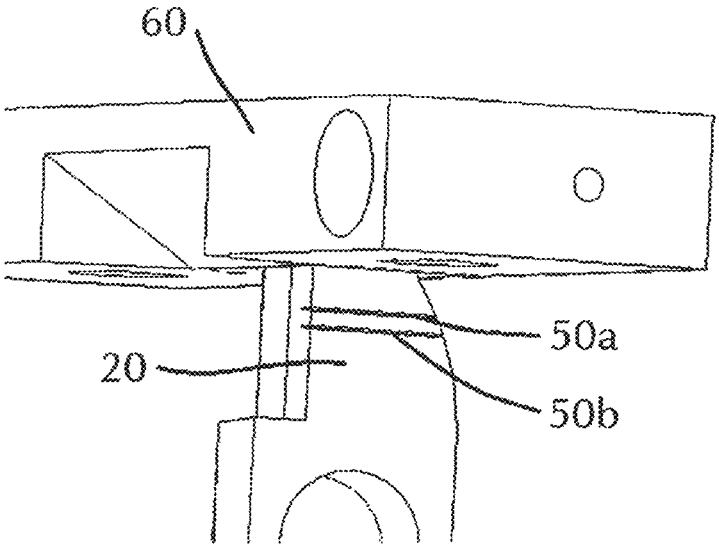

FIGS. 25-28 show an embodiment of a latch slide 20 in various states of engagement with a strike plate in a door jamb. As shown in FIG. 27, latch head 12 is engaged with the strike plate 60 at a distance in excess of indicia 50*b*, thereby increasing the force used to retract the latch head, likely beyond what is desirable for operation. In contrast, FIG. 28 shows too little engagement, such that the latch head projects into the strike plate opening at a distance less than as marked by indicia 50*a*, thereby possibly allowing the door to be opened with sufficient force, even if the latch is not retracted. FIGS. 25 and 26 depict a suggested engagement, such that the face of the strike plate 60 is positioned and maintained between indicia 50*a* and 50*b* on the latch head 12. FIG. 25 shows the strike plate from below and at a slightly upward angle, such that it can more clearly be seen that the face of the strike plate is maintained between indicia 50*a*, 50*b* during proper engagement of the latch head, while FIG. 26 shows a substantially planar view of the latch head and strike plate of FIG. 25.

Referring again to FIGS. 17-20, latch head 12 further comprises opposite sides 31*a*, 31*b* between the flat portion 30 and the angled or non-flat sweep side (i.e., strike portion) 40, wherein the latch head flat portion 30 comprises beveled edges 30*a*, 30*b* along the opposite sides. When the latch slide or latch slide 20 moves from the door toward the strike plate 60, and the latch head 12 is thereby extended into the strike plate opening, the beveled edges 30*a*, 30*b* prevent point contact with the inside of the strike plate opening and reduce the force used to retract the latch slide when the latch flat portion 30 is in contact with the inside of the strike plate opening.

Figure 35:
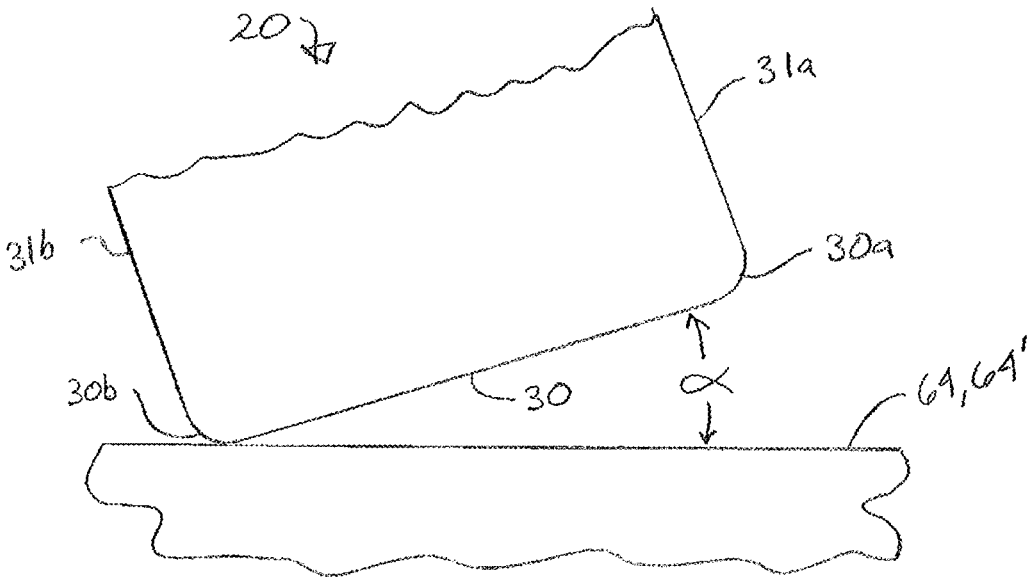
FIG. 35 is a top plan view of an embodiment of the latch head extended into and contacting the inside of a strike plate opening.

As shown in FIG. 35, latch head 20 has a planar face 30 between opposite latch head sides 31*a*, 31*b*. At the corners between planar face 30 and opposite latch head sides 31*a*, 31*b* there are beveled, angled surfaces 30*a*, 30*b*, respectively. In the embodiment shown, these surfaces are curved with a desired radius, but it should be understood by those skilled in the art than any otherwise non-flat surface is also contemplated. Because a door and the attached latch head may warp during service and opening of the door, instead of being parallel and flush in full contact with the inside of the strike plate opening, face 30 may be disposed at a slight angle a to the strike plate opening 64, 64' (shown in FIG. 35 at an exaggerated angle). Prior latch heads have essentially square corners that would make point contact with the strike plate opening when positioned at the angle shown, and possibly cause scoring of the strike plate and consequently additional force to be used to retract the latch. The curved edges 30*a*, 30*b* at the corners of the latch head face 30 present non-point contact, over a limited area, with strike plate opening 64, 64', which reduces and/or prevents such scoring and additional forces on the latch head during retraction.

Figure 30:
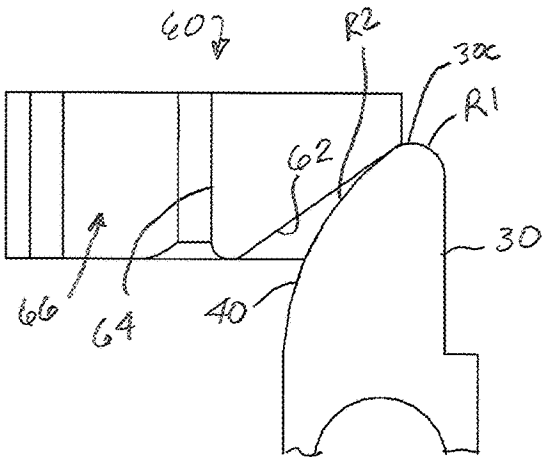
FIGS. 29-31 show an embodiment of a latch head transitioning from a latching position to a latched position with a manual strike.
Figure 31:
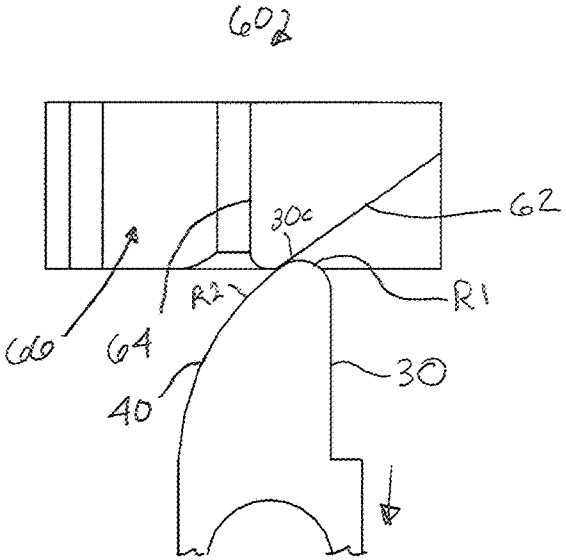
Figure 29:
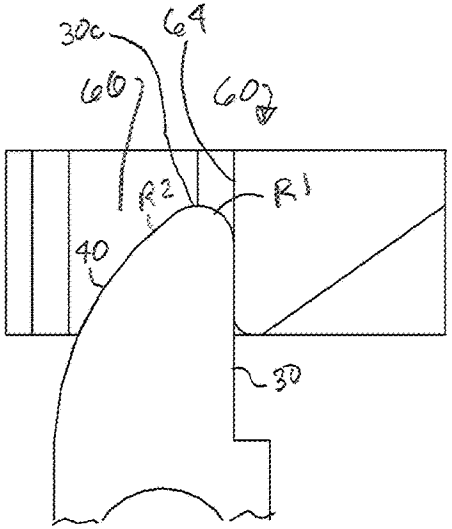
Figure 33:
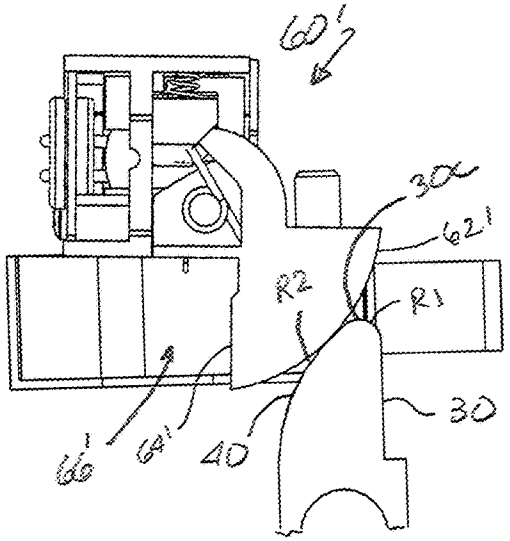
FIGS. 32-34 show an embodiment of a latch head transitioning from a latching position to a latched position with an electric strike.
Figure 32:
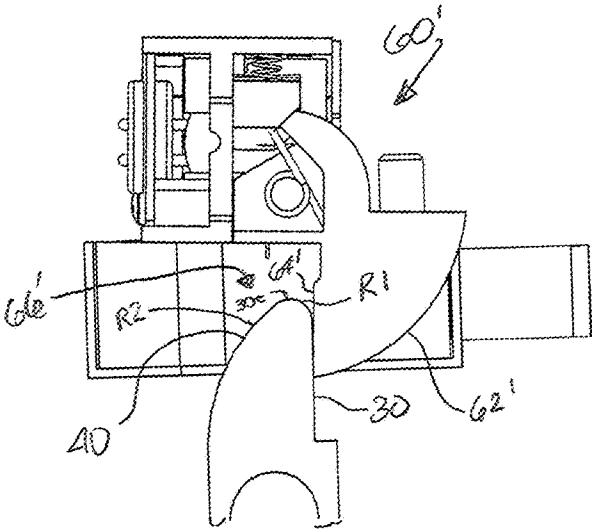
Figure 34:
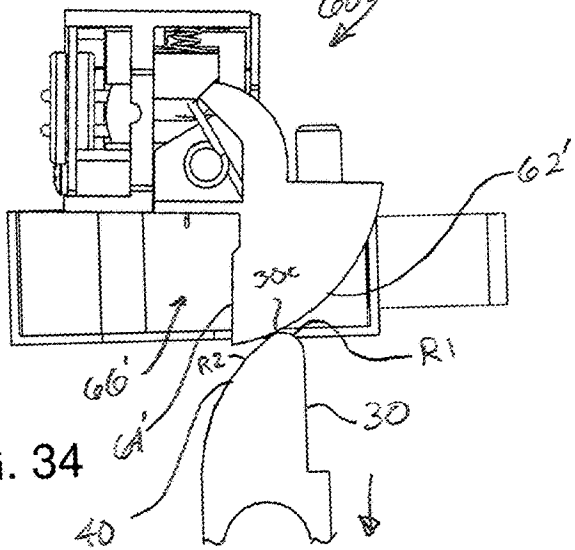

As best shown in FIGS. 19 and 22-24, latch head 12 further comprises a first radius R1 forming a transition portion at one end between flat portion 30 and angled sweep side (i.e., strike portion) 40, and a second radius R2 defining sweep side (i.e., strike portion) 40, wherein R2 is greater than R1. In an embodiment, R1 may be about ⅛" and R2 may be about 1", so as to enable the latch head to operate with either a manual strike 60, as shown in FIGS. 29-31, or an electric strike 60', as shown in FIGS. 32-34. With a sweep side (i.e., strike portion) radius R2 of about 1", approximately 4.5 lbs of force is used to open the latch. It should be understood by those skilled in the art that R1 and R2 are shown as about ⅛" and about 1", respectively, for exemplary purposes only, and that different radii may also be used for different operating force characteristics.

Latch head 12 further has a surface 30*c* at an upper end of the latch head between face 30 and sweep side (i.e., strike portion) 40 defining a smooth transition between radii R1, R2. Referring now to FIGS. 29-31, an embodiment of the latch head is shown transitioning from a latching position to a latched position with a manual strike (FIGS. 29-31) and an electric strike (FIGS. 32-34), respectively. In FIGS. 29 and 32, the door (not shown) is closed and the latch head is in the fully extended and locked position within strike plate opening 66, 66', so that face 30 contacts strike plate inside opening 64. Prior to this position, as shown in FIGS. 30 and 33, as the door is closing, the latch head sweep side (i.e., strike portion) 40 contacts the outside of the strike plate 62, 62' and as it is pushed to the right, the angle of sweep side (i.e., strike portion) 40, assisted by the angle of strike plate outside 62, causes the latch head to retract downward. Initially, the portion of sweep side (i.e., strike portion) 40 having radius R2 makes sliding contact with strike plate outside surface 62, 62'. FIGS. 31 and 34 show the latch head almost fully retracted downward as the door continues to close, so that the transition surface 30*c* between R1 and R2 makes sliding contact with strike plate outside 62, 62'. As the latch head goes beyond its upper end point and surface 30*c* is in contact with the strike plate, the portion of latch head having smaller radius R1 will contact the strike plate as the latch head is urged upward into the engaged position within the strike plate opening 66, 66'. Radii R1, R2 and the smooth transition surface 30*c* therebetween reduce opening and closing forces on the door during contact between latch head 12 and the strike plate 60.

According to exemplary embodiments described herein, a retrofit latch adapter provides an improved latch slide for facilitating installation and proper engagement between the latch head and the strike, comprising a latch head including a pair of visible indicia on at least one side thereof, one of the indicia indicating a minimum desired distance for extension of the latch head inside the strike plate opening and the other of the indicia indicating a maximum desired distance for extension. Proper engagement of the latch head may be determined by visually extending the latch head into the strike plate opening, moving the latch slide toward or away from the strike plate until the strike plate face is between the pair of indicia on the latch head, and setting the latch slide with respect to the actuator device so that the latch head when extended maintains the strike plate face between the pair of indicia on the latch head. A non-flat sweep side (i.e., strike portion) of the latch head contacts an outside surface of a strike plate to cause retraction of the latch head as the door is moved toward a closed position, and an opposite flat portion contacts an inside surface of an opening in a face of the strike plate to prevent the door from opening when the latch head is extended. The latch head further has beveled edges between the flat portion and the non-flat sweep side (i.e., strike portion) which provide non-point contact, over a limited surface area, with the inside of the strike plate opening and reduce the force used to retract the latch head when the latch head face is in contact with the inside of the strike plate opening.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method of installing a retrofit latch adapter in a pre-existing exit device, the retrofit latch adapter having a flat latch head, the method comprising:

rotationally releasing a pre-existing latch assembly having a roller latch head from the pre-existing exit device;

rotating the pre-existing latch assembly to linearly decouple the pre-existing latch assembly from a transmission of the pre-existing exit device;

removing the pre-existing latch assembly from the pre-existing exit device;

rotating the retrofit latch adapter to linearly couple the retrofit latch adapter to the transmission of the pre-existing exit device;

inserting the retrofit latch adapter at least partially into a housing of the pre-existing exit device;

aligning the flat latch head with an uppermost portion of the housing of the pre-existing exit device; and rotationally securing the retrofit latch adapter to the pre-existing exit device.

2. The method of claim 1, wherein rotationally releasing a pre-existing latch assembly from the pre-existing exit device comprises slidably releasing the transmission of the pre-existing exit device from the pre-existing exit device housing.

3. The method of claim 2, wherein slidably releasing the transmission from the pre-existing exit device housing comprises unthreading a dog button from the transmission.

4. The method of claim 2, wherein slidably releasing the transmission from the pre-existing exit device housing comprises detaching a plate from the pre-existing exit device housing.

5. The method of claim 2, further comprising sliding the transmission at least partially out of the pre-existing exit device housing.

6. The method of claim 5, wherein inserting the retrofit latch adapter comprises moving the transmission fully into the pre-existing exit device housing.

7. The method of claim 6, further comprising slidably securing the transmission of the pre-existing exit device to the pre-existing exit device housing.

8. The method of claim 7, wherein slidably securing the transmission to the pre-existing exit device housing comprises threading a dog button into the transmission.

9. The method of claim 7, wherein slidably securing the transmission to the pre-existing exit device housing comprises reattaching the plate to the pre-existing exit device housing.

10. The method of claim 1, wherein rotationally releasing the pre-existing latch assembly comprises removing at least one insert fastener from the pre-existing exit device housing, wherein rotationally securing the retrofit latch adapter to the pre-existing exit device comprises replacing the at least one insert fastener in the pre-existing exit device housing.

11. The method of claim 1, wherein rotating the pre-existing latch assembly comprises unthreading a latch rod of the pre-existing latch assembly from the transmission.

12. The method of claim 1, wherein rotating the retrofit latch adapter comprises threading a latch rod of the retrofit latch adapter into the transmission.

13. The method of claim 12, wherein threading the latch rod of the retrofit latch adapter includes threading the latch rod into the transmission between or approximately equal to 0.75" and 1".

14. The method of claim 1, wherein inserting the retrofit latch adapter into the pre-existing exit device housing comprises attaching a latch insert to the retrofit latch adapter.

15. The method of claim 14, wherein inserting the retrofit latch adapter into the pre-existing exit device housing further comprises aligning a hole in the pre-existing exit device housing with a hole in the latch insert.

16. The method of claim 1, wherein inserting the retrofit latch adapter into the pre-existing exit device housing comprises:

inserting the retrofit latch adapter at least partially into the pre-existing exit device housing;

rotating the retrofit latch adapter approximately 90 degrees in a first direction;

inserting the retrofit latch adapter further into the pre-existing exit device housing; and rotating the retrofit latch adapter approximately 90 degrees in a second direction opposite the first direction.

17. The method of claim 1, further comprising rotating the retrofit latch adapter to increase or reduce a distance between a distal most portion of the pre-existing exit device housing and a distal most portion of the retrofit latch adapter.

18. The method of claim 17, wherein rotating the retrofit latch adapter adjusts the distance to approximately 0.75".

* * * * *